US007469110B2

(12) United States Patent
Nakazato et al.

(10) Patent No.: US 7,469,110 B2
(45) Date of Patent: Dec. 23, 2008

(54) IMAGE FORMING APPARATUS AND METHOD INCLUDING CANCELING A POWER SAVE MODE

(75) Inventors: Hiroshi Nakazato, Nagano-ken (JP); Ken Ikuma, Nagano-ken (JP); Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 416 days.

(21) Appl. No.: 10/560,333

(22) PCT Filed: Oct. 15, 2004

(86) PCT No.: PCT/JP2004/015227

§ 371 (c)(1),
(2), (4) Date: Dec. 9, 2005

(87) PCT Pub. No.: WO2005/038537

PCT Pub. Date: Apr. 28, 2005

(65) Prior Publication Data

US 2007/0092280 A1 Apr. 26, 2007

(30) Foreign Application Priority Data

Oct. 16, 2003 (JP) ..... 2003-356135
Oct. 16, 2003 (JP) ..... 2003-356136
Oct. 17, 2003 (JP) ..... 2003-357639
Oct. 13, 2004 (JP) ..... 2004-299181
Oct. 14, 2004 (JP) ..... 2004-300383

(51) Int. Cl.
*G03G 15/00* (2006.01)

(52) U.S. Cl. ..... 399/88; 399/37

(58) Field of Classification Search ..... 399/37, 399/75, 88, 90

See application file for complete search history.

(56) References Cited

U.S. PATENT DOCUMENTS 4,745,436 A * 5/1988 Matsuura ..... 399/70
6,134,401 A 10/2000 Yun et al.
6,295,429 B1 * 9/2001 Isobe et al. ..... 399/227
6,301,450 B1 10/2001 Kojima et al.

FOREIGN PATENT DOCUMENTS

JP 09-101723 4/1997

(Continued)

*Primary Examiner*—David M Gray
*Assistant Examiner*—Joseph S. Wong
(74) *Attorney, Agent, or Firm*—Hogan & Hartson LLP

(57) ABSTRACT

An image forming apparatus adapted for a smooth mounting/dismounting of a process unit and for the reduction of wasteful power consumption is provided.

Unless a new image signal is applied after completion of an image forming operation, the apparatus starts a clocking operation by an internal timer (Step S101). If the apparatus is left standstill for a predetermined length of time (Step S102), a sleep process (Step S103) is executed to shift the apparatus to a power save mode to consume less power. When an outside cover is opened (Step S105), on the other hand, the apparatus is shifted to a replacement operation mode (Step S106) in which only the rotation of a development rotary is permitted. However, if the apparatus is left with the outside cover opened (Step S108), the sleep process is executed.

7 Claims, 20 Drawing Sheets

| CONTROL SIGNAL | | | OPERATION MODE (DESCRIPTION) |
|---|---|---|---|
| EN1 | EN2 | EN3 | |
| H | H | H | NORMAL OPERATION MODE (PERMIT DRIVE OF ALL UNITS) |
| H | H | L | REPLACEMENT OPERATION MODE (PERMIT DRIVE OF ONLY DEVELOPING UNIT) |
| H | L | L | ALL-DISABLE MODE (INHIBIT DRIVE OF ALL UNITS) |
| L | ϕ | ϕ | POWER SAVE MODE (DEACTIVATE DRIVE POWER SOURCE) |

FOREIGN PATENT DOCUMENTS

| | | |
|---|---|---|
| JP | 09-160447 | 6/1997 |
| JP | 10-297059 | 11/1998 |
| JP | 10-301463 | 11/1998 |
| JP | 2000-085209 | 3/2000 |
| JP | 2000-172127 | 6/2000 |
| JP | 2000-333459 | 11/2000 |
| JP | 2001-134153 | 5/2001 |
| JP | 2002-019232 | 1/2002 |
| JP | 2002-144677 | 5/2002 |
| JP | 2002-169425 | 6/2002 |
| JP | 2002-204321 | 7/2002 |
| JP | 2002-333756 | 11/2002 |
| JP | 2003-114567 | 4/2003 |
| JP | 2003-173080 | 6/2003 |
| JP | 2003-295573 | 10/2003 |
| JP | 2004-109166 | 4/2004 |

* cited by examiner

FIG. 5A : HOME POSITION
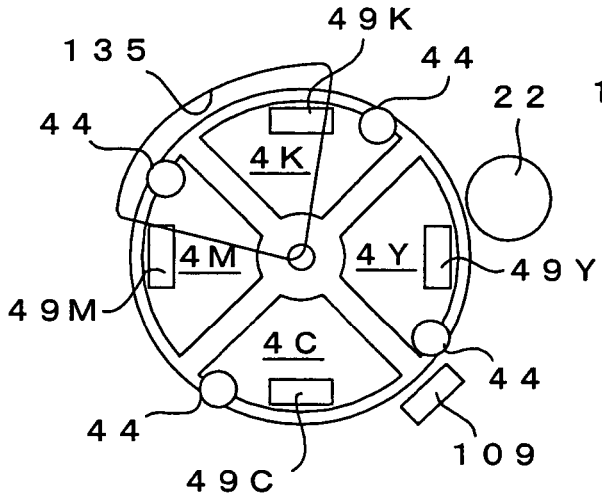
FIG. 5B : DEVELOPMENT POSITION
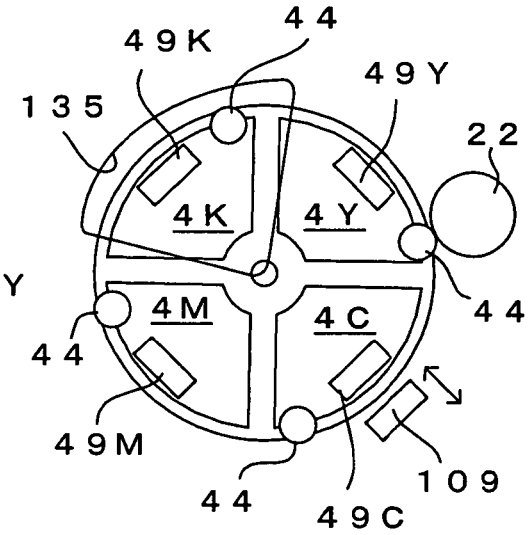
FIG. 5C : MOUNTING/DISMOUNTING POSITION
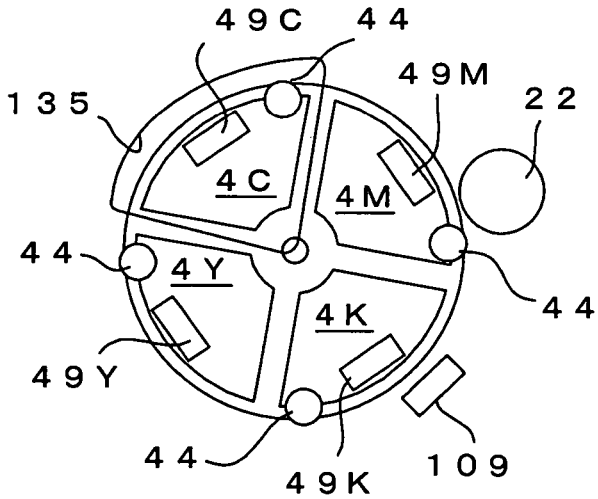

FIG. 7

| CONTROL SIGNAL | | | OPERATION MODE (DESCRIPTION) |
|---|---|---|---|
| EN1 | EN2 | EN3 | |
| H | H | H | NORMAL OPERATION MODE (PERMIT DRIVE OF ALL UNITS) |
| H | H | L | REPLACEMENT OPERATION MODE (PERMIT DRIVE OF ONLY DEVELOPING UNIT) |
| H | L | L | ALL-DISABLE MODE (INHIBIT DRIVE OF ALL UNITS) |
| L | φ | φ | POWER SAVE MODE (DEACTIVATE DRIVE POWER SOURCE) |

FIG. 19

| COMPONENT | OPERATION MODE | | | | | |
|---|---|---|---|---|---|---|
| | IMAGE FORMATION | (REPLACEMENT 1) | POWER SAVE 1 | (REPLACEMENT 2) | POWER SAVE 2 | (REPLACEMENT 3) |
| CONTROL CIRCUITS | ○ | ○ | ○ | ○ | ○ | ○ |
| DISPLAY | ○ | ○ | ○ | ○ | — | ○ |
| HIGH-VOLTAGE SOURCE | ○ | — | — | — | — | — |
| EXPOSURE UNIT | ○ | ○ | — | — | — | — |
| ROTARY DRIVER | ○ | ○ | — | ○ | — | ○ |
| DEVELOPING ROLLER DRIVER | ○ | — | — | — | — | — |
| PHOTOSENSITIVE MEMBER/INTERMEDIATE TRANSFER BELT DRIVERS | ○ | — | — | — | — | — |
| FIXING UNIT | ○ | ○ | (LOW TEMPERATURE) | — | — | — |
| COOLING FAN | ○ | (LOW SPEED) | (LOW SPEED) | (LOW SPEED) | — | — |

IMAGE FORMING APPARATUS AND METHOD INCLUDING CANCELING A POWER SAVE MODE

TECHNICAL FIELD

The present invention relates to an image forming apparatus including a process unit removably mountable in an apparatus body, and a control method thereof.

BACKGROUND ART

In image forming apparatuses such as printers, copiers and facsimile machines, the process unit is generally adapted to be removably mounted in the apparatus body for the purpose of replacing a consumable article. To manage use conditions of individual units for ensuring proper replacement of consumable articles, such apparatuses include one which is arranged to permit a user to perform a unit mounting/dismounting operation only when the apparatus is in a state to be able to confirm the mounting/dismounting of the unit. For instance, an image forming apparatus set forth in Patent Document 1 is arranged to permit the dismounting of a developing unit when a development rotary adapted to be removably mounted with the developing unit is rotatably positioned at a predetermined dismounting position, and is also arranged to inhibit the dismounting of the developing unit when the development rotary is positioned otherwise. Since the apparatus positions the development rotary under control of a controller, the apparatus is able to confirm the unit mounting/dismounting operation performed by the user.

On the other hand, the image forming apparatus of this type is required to consume less power in a state where an image forming operation is not performed or to reduce a so-called standby power requirement. To achieve this object, an apparatus has been proposed which is adapted to deactivate a power supply circuit for supplying electric power to a high power load such as a motor. For instance, an image forming apparatus set forth in Patent Document 2 is designed to use microcomputer control for turning on or off power supply to a power supply circuit for power system.

Patent Document 1: Japanese Patent Application Laid-Open Gazette No. 2002-333756

Patent Document 2: Japanese Patent Application Laid-Open Gazette No. 2000-333459

DISCLOSURE OF THE INVENTION

Problems to Be Solved by the Invention

The aforesaid image forming apparatus of Patent Document 1 may also be able to reduce the standby power requirement by applying thereto the technique set forth in the Patent Document 2. However, there may be a case where the user wants to replace the unit while the apparatus is on standby. To meet this need, the apparatus cannot deactivate the power supply circuit. This is because the mounting/dismounting of the unit requires the development rotary to be rotated into position. That is, this positioning operation is disabled if the power supply circuit is deactivated.

In the apparatus arranged to perform the predetermined operation permit the user to perform the unit mounting/dismounting operation, it is impracticable to achieve the reduction of standby power requirement as well as to offer user convenience in performing the unit mounting/dismounting operation. A sufficient study has not been made on a control technique enabling the apparatus to achieve both of these goals.

According to the aforesaid image forming apparatus of Patent Document 1, the apparatus is returned to a normal state after completion of the mounting/dismounting operation by the user, the normal state inhibiting the mounting/dismounting of a developer. Specifically, the development rotary is moved to a home position provided independently from the dismounting position, whereby the mounting/dismounting of the developer is inhibited. The completion of the operation by the user may be determined by, for example, detecting a closure of a cover.

In cases, however, the user may make a mistake in the operation so that the cover is closed with the process unit such as the developer improperly dismounted/mounted. If, in this case, the user opens the cover again intending to proceed with the previous operation, the apparatus is already returned to the state to inhibit the mounting/dismounting of the unit. This leads to vexations that the user must start the operation from the beginning again and besides, must wait till the apparatus is placed again in the state to permit the mounting/dismounting of the unit.

Means for Solving the Problems

The invention has a first object to provide an image forming apparatus and a control method thereof, which are adapted to reduce wasteful power consumption without impairing the user convenience in performing the unit mounting/dismounting operation. In an image forming apparatus including the process unit removably mountable in the apparatus body and a control method thereof, a second object of the invention is to enhance the user convenience in performing the unit mounting/dismounting operation.

A first aspect of the present invention pertains to an image forming apparatus comprising: a process unit capable of being removably mounted in an apparatus body; and a switching unit for switching the apparatus between a state to permit the mounting/dismounting of the process unit and a state to inhibit the mounting/dismounting of the process unit, and to a control method thereof. For achieving the first object described above, the first aspect is characterized in that an image forming mode to form an image by means of the process unit; a first standby mode in which a switching operation by the switching unit is permitted while some of the parts of the apparatus, except for the switching unit, are deactivated; or a second standby mode in which the switching unit is deactivated in addition to those deactivated in the first standby mode, thereby reducing power consumption from that of the first standby mode, is selectively executed as required, and that the second standby mode is started when a predetermined length of time has passed from the start of the first standby mode.

A second aspect of the present invention pertains to an image forming apparatus comprising: a process unit capable of being removably mounted in an apparatus body; a switching unit for switching the apparatus between a state to permit the mounting/dismounting of the process unit and a state to inhibit the mounting/dismounting of the process unit; and a cover member which is free to be shifted between an open position and a close position with respect to the apparatus body and which, in the close position, serves to restrict an operation of mounting/dismounting the process unit by a user, and to a control method thereof. For achieving the first object described above, the second aspect is characterized in that a power save mode in which the apparatus consumes less power than that consumed during an image forming operation is executed as required by deactivating some parts, inclusive of the switching unit, of the apparatus, and that when the cover member is opened during the execution of the power save mode, the power save mode is cancelled to shift the apparatus to a state to permit an operation of the switching unit.

A third aspect of the present invention pertains to an image forming apparatus comprising: a process unit capable of being removably mounted in an apparatus body; a switching unit for switching the apparatus between a state to permit the mounting/dismounting of the process unit and a state to inhibit the mounting/dismounting of the process unit; and a cover member which is free to be shifted between an open position and a close position with respect to the apparatus body and which, in the close position, serves to restrict an operation of mounting/dismounting the process unit by a user, and to a control method thereof. For achieving the second object described above, the third aspect is characterized in that in a case where the cover member is closed when the apparatus is in the state to permit the mounting/dismounting of the process unit, a mounting/dismounting inhibition process is executed in which the switching unit is controlled after the lapse of a predetermined start waiting time so as to shift the apparatus to the state to inhibit the mounting/dismounting of the process unit, and that in a case where the mounting/dismounting of the process unit is undone before the closure of the cover member, the start waiting time is made longer than that of a case where the mounting/dismounting of the process unit is done.

Further, a fourth aspect of the present invention pertains to a control method of an image forming apparatus including a process unit capable of being removably mounted in an apparatus body. For achieving the first object described above, the fourth aspect is characterized in that one of the two or more operation modes is selectively executed, the operation modes including: an image forming mode to form an image according to an image forming request, and a power save mode in which some of the parts of the apparatus are deactivated thereby reducing the power consumption of the apparatus from that of the image forming mode, and that when the mounting/dismounting of the process unit is performed during the execution of the image forming mode, the apparatus is placed in a first mounting/dismounting permission state to permit the mounting/dismounting of the process unit, while when the mounting/dismounting of the process unit is performed during the execution of the power save mode, the apparatus is placed in a second mounting/dismounting permission state to deactivate some parts of the apparatus in addition to those deactivated in the first mounting/dismounting permission state.

Effects of the Invention

According to the invention, the image forming apparatus including the process unit capable of being removably mounted in the apparatus body and the control method thereof are adapted to reduce the wasteful power consumption without impairing the user convenience in performing the operation of mounting/dismounting the process unit. According to the first aspect, the first standby mode is executed to enable the operation of the switching unit for shifting the apparatus to the state to permit the mounting/dismounting of the process unit, so that the mounting/dismounting of the process unit may be carried out while some parts of the apparatus, except for the switching unit, are deactivated. After the lapse of the predetermined length of time from the start of the first standby mode, the second standby mode is executed to deactivate the switching unit as well. Therefore, if the apparatus is left standstill in the course of performing the mounting/dismounting operation, the apparatus is shifted to the state to consume even less power after the lapse of the predetermined length of time. Thus is reduced the wasteful power consumption. In this manner, the invention ensures that a good efficiency of the operation of mounting/dismounting the process unit by the user is maintained while the wasteful power consumption is reduced even when the apparatus is left standstill in the course of the operation.

According to the second aspect, the power consumption during standby may be reduced by executing the power save mode in which the apparatus consumes less power. Furthermore, the apparatus is arranged such that despite the execution of the power save mode, the apparatus recovers from the power save mode when the cover member serving to restrict the mounting/dismounting operation by the user is opened. In the image forming apparatus according to the invention, the mounting/dismounting of the process unit is not permitted in the sate where the cover member is closed. The mounting/dismounting of the process unit is permitted only in the state where the cover member is opened. That is, the user takes the steps of first opening the cover member and then performing the mounting/dismounting of the process unit. Therefore, if the apparatus cancels the execution of the power save mode at the time when the cover member is opened, and is placed in the state to permit the operation of the switching unit, the apparatus is able to deal with the subsequent mounting/dismounting operation properly and quickly. Thus, the invention may constitute the image forming apparatus featuring the lower power consumption during standby and the good user convenience in performing the mounting/dismounting operation.

According to the third aspect in the case where the cover member is closed with the mounting/dismounting of the process unit yet to be done, the longer start waiting time than where the mounting/dismounting operation is followed by the closure of the cover member is provided before the mounting/dismounting inhibition process is started. If the user opens again the cover member during the start waiting time, the apparatus is maintained in the state to permit the mounting/dismounting of the process unit and hence, the user is allowed to proceed with the mounting/dismounting operation. Thus, the invention can improve the user convenience in performing the operation of mounting/dismounting the process unit.

According to the fourth aspect, the mounting/dismounting permission state corresponding to the image forming mode, and the mounting/dismounting permission state consuming less power and corresponding to the power save mode are discretely provided. Such a constitution permits the operation statuses of the parts of the apparatus in the mounting/dismounting permission state to be discretely set according to each operation mode. Therefore, the power consumed for performing the mounting/dismounting of the unit during the execution of the power save mode may be reduced, so that the power consumption may be even further reduced as compared with the apparatus wherein the power save mode is cancelled when the mounting/dismounting of the unit is to be performed. Whether in the image forming mode or in the power save mode, the apparatus permits the mounting/dismounting of the unit so that the mounting/dismounting operation may be performed efficiently. Thus, the image forming apparatus and the control method thereof according to the invention permit the user to perform the operation of mounting/dismounting the process unit efficiently and besides, reduce the wasteful power consumption.

BRIEF DESCRIPTION OF THE DRAWINGS

FIG. 5 is a group of schematic diagrams which show stop positions of the developer cartridge;

FIG. 7 is a table which shows correspondence between the individual operation modes and the set values of individual control signals;

FIG. 19 is a table which shows operation statuses of the individual parts of the apparatus in each of the operation modes.

DESCRIPTION OF REFERENCE CHARACTERS

4: developing unit (switching unit)
4Y, 4M, 4C, 4K: developer (process unit)
10: engine controller (controller)
120: outside cover (cover member)
130: inside cover (restricting member)

BEST MODES FOR CARRYING OUT THE INVENTION

First Preferred Embodiment

Figure 1:
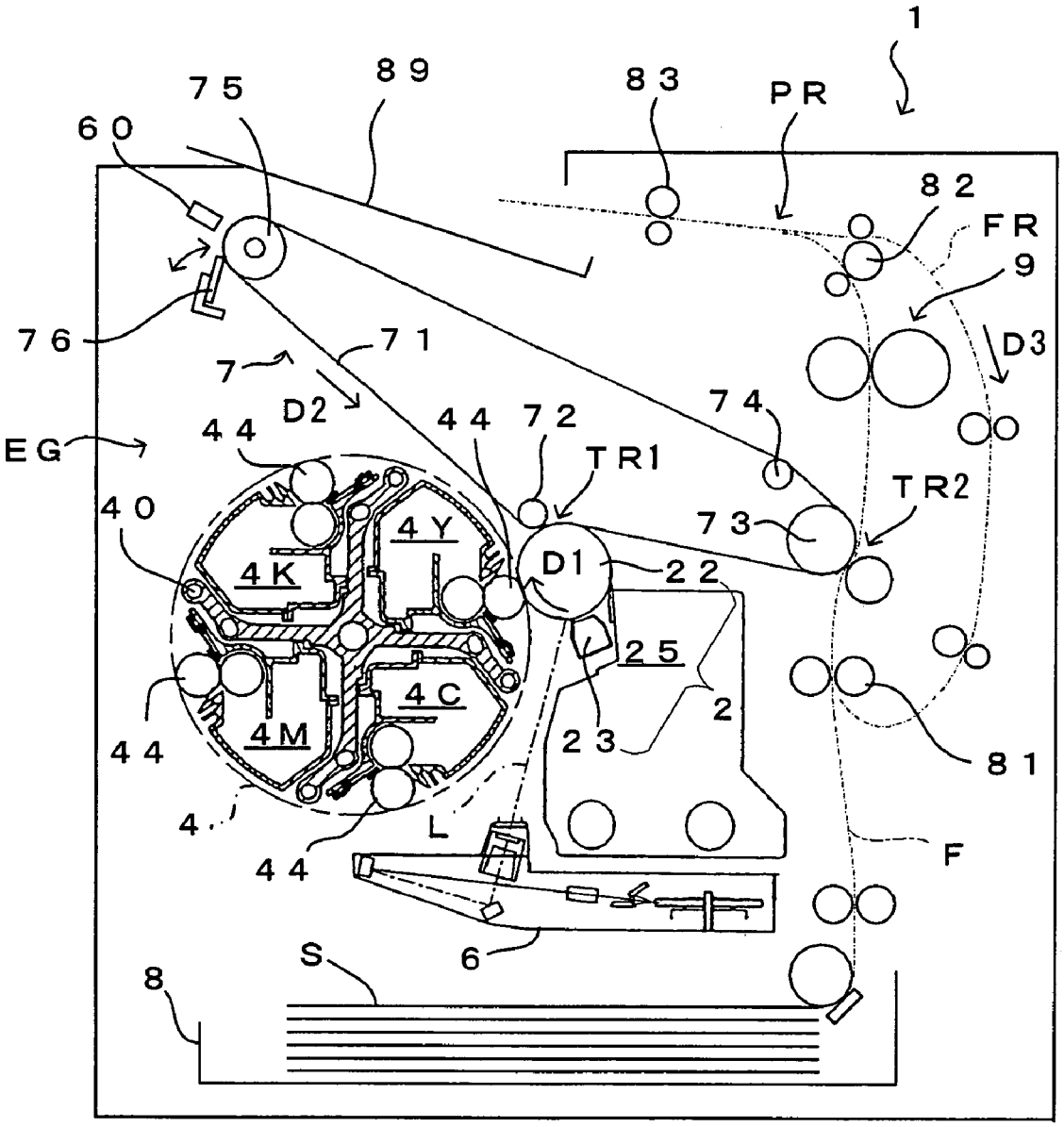
FIG. 1 is a drawing which shows a first preferred embodiment of an image forming apparatus according to the present invention.
Figure 2:
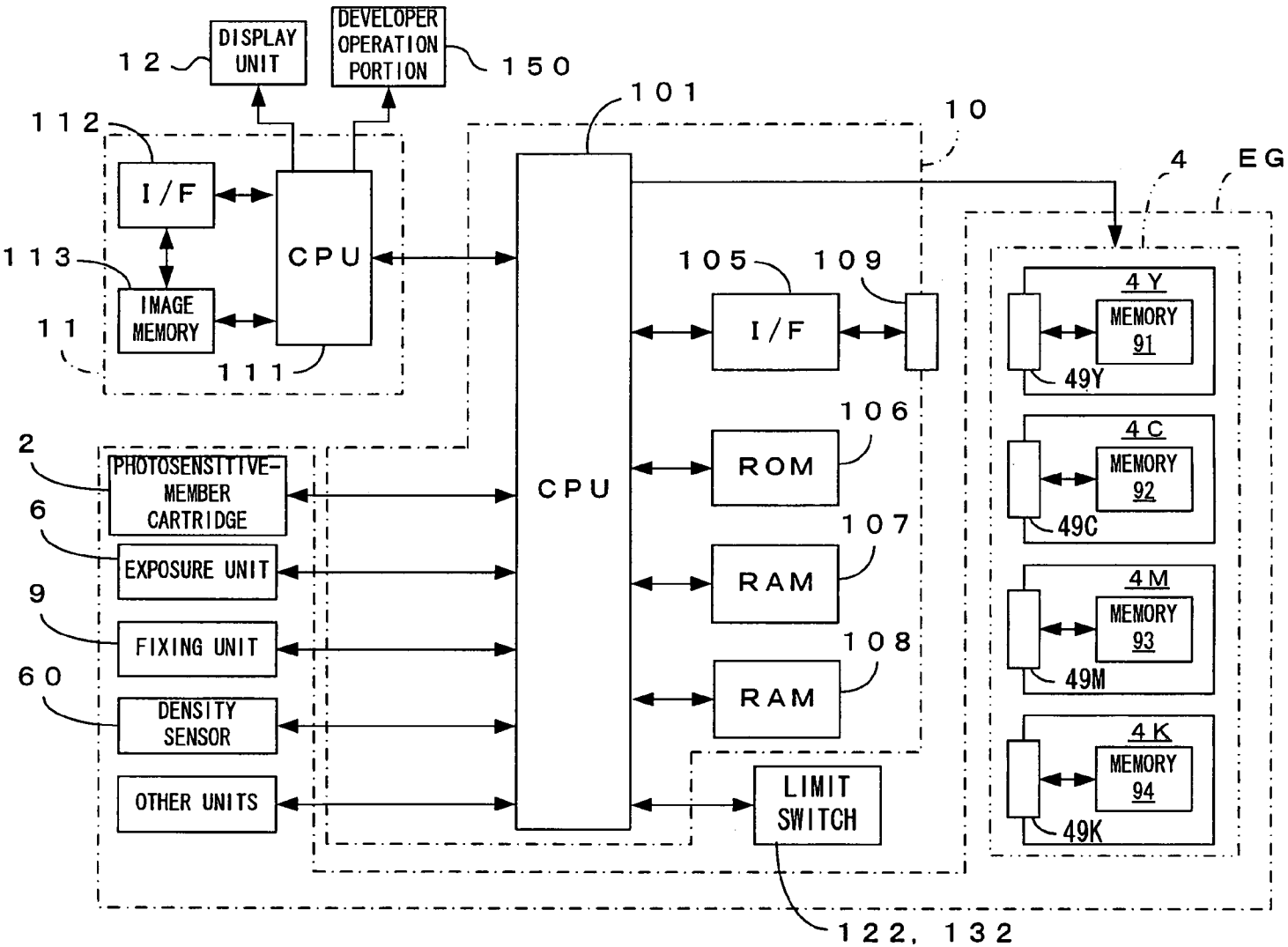
FIG. 2 is a block diagram which shows an electric structure of the apparatus of FIG. 1.

FIG. 1 is a drawing which shows a first preferred embodiment of an image forming apparatus according to the present invention. FIG. 2 is a block diagram which shows an electric structure of the apparatus of FIG. 1. This apparatus 1 is an image forming apparatus for forming a full color image by superimposing images of toners of four colors: yellow (Y), cyan (C), magenta (M) and black (K) and forming a monochromatic image only using the black (K) toner. In this image forming apparatus 1, when a print command signal including an image signal is given from an external apparatus such as a host computer to a main controller 11, an engine controller 10 controls individual parts of an engine section EG for executing a specified image forming operation in accordance with a command from the main controller 11, whereby an image corresponding to the image signal is formed on a sheet S.

In this engine section EG, a photosensitive member 22 is rotatably provided in a direction of arrow D1 of FIG. 1. Further, a charger unit 23, a rotary developing unit 4 and a cleaning section 25 are arranged around the photosensitive member 22 along its rotating direction D1. A specified charging bias is applied to the charger unit 23 to uniformly charge the outer circumferential surface of the photosensitive member 22 at a specified surface potential. The cleaning section 25 removes the toner residual on the outer surface of the photosensitive member 22 after a primary transfer and collects it in a waste toner tank provided therein. The photosensitive member 22, the charger unit 23 and the cleaning section 25 are incorporated into a photosensitive-member cartridge 2, which is detachably mountable into a main body of the apparatus 1 as a single unit.

A light beam L is emitted from an exposure unit 6 toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The thus formed electrostatic latent image is developed into a toner image by the rotary developing unit 4. The developing unit 4 includes: a supporting frame 40 rotatably provided about a rotary shaft perpendicular to the drawing surface of FIG. 1; a developer for yellow 4Y; a developer for cyan 4C; a developer for magenta 4M; a developer for black 4K; and a rotary driving device (described later) for driving these components into unitary rotation. The four developers 4Y, 4C, 4M and 4K contain the toners of the respective colors and are constructed as cartridges detachably mountable into the supporting frame 40. This developing unit 4 is controlled by the engine controller 10. When the developing unit 4 is rotated in accordance with a control command from the CPU 101 and the developers 4Y, 4C, 4M, 4K thereof are selectively brought into contact with the photosensitive member 22 or positioned at a specified developing position facing the photosensitive member 22 at a specified gap, the toner is imparted from a developing roller 44 provided in this developer and carrying the toner of the selected color to the outer surface of the photosensitive member 22. In this way, the electrostatic latent image on the photosensitive member 22 is developed in the selected toner color.

The toner image developed by the developing unit 4 as described above undergoes a primary transfer onto an intermediate transfer belt 71 of a transfer unit 7 in a primary transfer region TR1. The transfer unit 7 includes the intermediate transfer belt 71 mounted on a plurality of rollers 72 to 75 and a driving device for driving the roller 73 to turn the intermediate transfer belt 71 in a specified turning direction D2. In the case of transferring a color image onto the sheet S, the toner images of the respective colors formed on the photosensitive member 22 are superimposed on the intermediate transfer belt 71 to form the color image, which then undergoes a second transfer onto the sheet S dispensed one by one from a cassette 8 and conveyed to a secondary transfer region TR2 along a conveyance path F.

At this time, a timing at which the sheet S is fed to the secondary transfer region TR2 is controlled in order to properly transfer the image on the intermediate transfer belt 71 to a specified position on the sheet S. Specifically, gate rollers 81 are provided before the second transfer region TR2 in the conveyance path F, and the sheet S is fed to the secondary transfer region TR2 at a specified timing by rotating the gate rollers 81 in conformity with a turning timing of the intermediate transfer belt 71.

The sheet S having the color image thus formed thereon is conveyed to be discharged onto a discharge tray 89 provided on the upper surface of the apparatus main body 1 via a fixing unit 9, pre-discharge rollers 82 and discharge rollers 83. Further, in the case of forming images on both surfaces of the sheet S, the rotating directions of the discharge rollers 83 are reversed when the trailing end of the sheet S having the image formed on one surface thereof as described above reaches a reversing position PR behind the pre-discharge rollers 82, whereby the sheet S is conveyed in a direction of arrow D3 along a reversing conveyance path FR. Then, the sheet S enters the conveyance path F again before the gate rollers 81. At this time, the surface of the sheet S to be brought into contact with the intermediate transfer belt 71 in the secondary transfer region TR2 to have an image transferred thereto is the surface opposite from the one where the image was already transferred. In this way, the images can be formed on both surfaces of the sheet S.

Further, there are a density sensor 60 and a cleaner 76 in the vicinity of the roller 75. The density sensor 60 optically detects a toner amount which constitutes a toner image formed on the intermediate transfer belt 71 when needed. Specifically, the density sensor 60 irradiates light toward the toner image, receives reflection light from the toner image, and outputs a signal corresponding to a reflection light amount. The cleaner 76 can be attached to and detached from the intermediate transfer belt 71. When abutting on the intermediate transfer belt 71 as needed, the cleaner 76 scrapes off the toner remaining on the intermediate transfer belt 71 and the toner which constitutes the toner image.

As shown in FIG. 2, nonvolatile memories 91 through 94 are disposed onto the developers 4Y, 4C, 4M, 4K, respectively. These nonvolatile memories 91 through 94 are adapted to save data on the production lots, the used states, the remaining amount of the contained toner and the like of the developer. Furthermore, the developers 4Y, 4C, 4M, 4K include connectors 49Y, 49C, 49M, 49K, respectively. When needed, the connectors 49Y, 49C, 49M, 49K are selectively brought into contact with a connector 109 of the apparatus main body. Accordingly, the CPU 101 and the memory 91 through 94 can exchange data via the interface 105, whereby the administration of the informations regarding the consumable supplies are carried out. In this embodiment, the developer side connector 49Y, 49C, 49M, 49K is mechanically connected with the main-body side connector 109 to carry out the reading and writing from and in the memory 91 through 94. However, the reading and writing may be carried out in a noncontacting manner using an electromagnetic means such as a radio communication.

In FIG. 2, a reference numeral 113 represents an image memory provided in the main controller 11 in order to store the image supplied from the external apparatus, such as a host computer, via an interface 112. A reference numeral 106 represents a ROM for storage of an operation program executed by the CPU 101 and control data used for controlling the engine section EG. A reference numeral 107 represents a RAM for temporary storage of operation results given by the CPU 101 and other data. Further, a reference numeral 108 represents a RAM for saving information on the used states of the respective units of the engine section EG, such as the developer 4Y To save information related to the states of use of the respective portions of the apparatus, it is preferable to use non-volatile memories which save information even when not energized as these RAMs 108 and 91 through 94. As such elements, flash memories, ferroelectric memories or the like may be used.

Furthermore, the apparatus 1 is also provided with a display 12 controlled by a CPU 111 of the main controller 11 as shown in FIG. 2. This display 12, which is composed of a liquid crystal display for instance, is adapted to display operation guides to the user, the progress of an image forming operation, and specified messages for notifying an occurrence of an abnormality in the apparatus or a change timing of any unit.

In addition, limit switches 122 and 132 for sensing whether the covers disposed to the housing of the apparatus are open or close are connected to a CPU 101 of this apparatus 1. These will be described in detail later.

Figure 3:
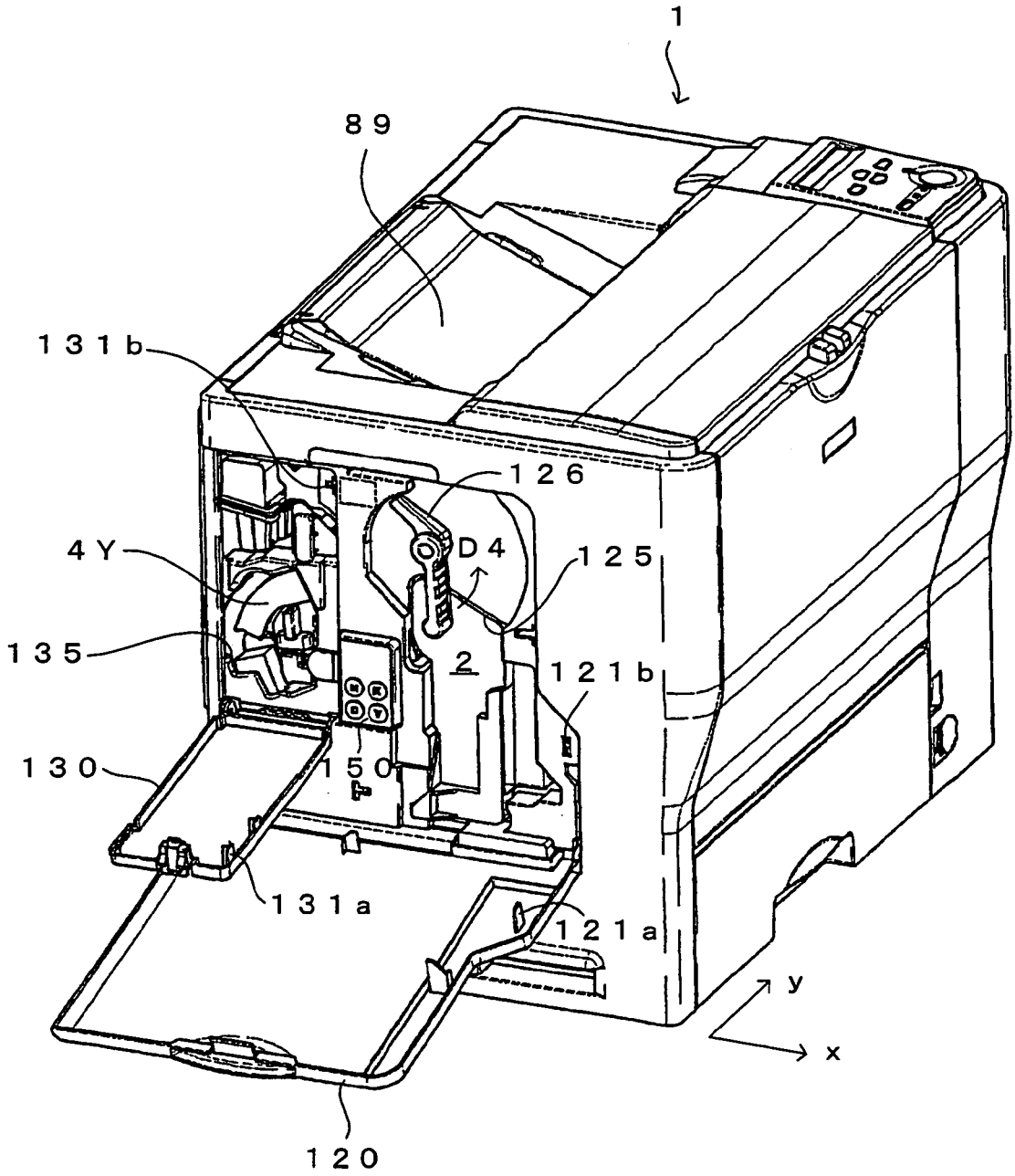
FIG. 3 is a drawing which shows an external appearance of the image forming apparatus shown in FIG. 1.

FIG. 3 is a drawing which shows an external appearance of the image forming apparatus shown in FIG. 1. As described earlier, developers 4Y, . . . are freely attachable to and detachable from a support frame 40 in the image forming apparatus 1. Further, a photosensitive cartridge 2 is freely attachable to and detachable from the main body of the apparatus. As shown in FIG. 3, an external cover 120 which can be opened and closed freely is attached to a side surface portion of the main body of the apparatus 1. When a user opens the external cover 120, a side surface portion of the photosensitive cartridge 2 is exposed through a photosensitive opening 125 which is formed in the main body of the apparatus. As a lock lever 126 for fixing the photosensitive cartridge 2 is revolved in the direction of the arrow D4, the lock is released, making it possible to pull out the photosensitive cartridge 2 along the direction of the axis (−y) in FIG. 3. Further, when a new photosensitive cartridge 2 is inserted along the direction of the axis y shown in FIG. 3 through the photosensitive opening 125, the new photosensitive cartridge 2 is attached. The photosensitive cartridge 2 is then fixed with the lock lever 125. As the photosensitive cartridge 2 is attached in this fashion, the side surface portion of the photosensitive cartridge 2 almost completely closes the photosensitive opening 125.

In addition, the main body of the apparatus has a developer opening 135 which is for attaching and detaching the developer cartridges. An internal cover 130 which can be opened and closed freely is disposed so as to cover the developer opening 135. The internal cover 130 is disposed inside the external cover 120. In short, since the external cover 120 is disposed covering even the developer opening 135, the internal cover 130 cannot be opened when the external cover 120 is closed. Conversely, unless the internal cover 130 is closed, the external cover 120 cannot be closed. When a user opens the internal cover 130, as long as a developer unit 4 is in a halt at a predetermined attaching/detaching position, it is possible to take out one of the attached developers through the developer opening 135. Further, at this stage, it is possible to attach one developer through the developer opening 135.

While a projection 121*a* is formed in the external cover 120, the main body has a hole 121*b* located at a position corresponding to the projection 121*a*. Further, the limit switch 122 which will be described later is attached to a bottom portion of the hole 121*b*. When the external cover 120 is closed, the projection 121*a* is inserted in the hole 121*b* which is formed in the main body, and the contact of the limit switch 122 disposed to the bottom portion of the hole 121*b* is closed.

The internal cover 130 comprises a similar mechanism to this. That is, while a projection 131*a* is disposed to the internal cover 130, the main body has a hole 131*b* located at a position corresponding to the projection 131*a*. As the internal cover 130 is closed, the projection 131*a* is inserted in the hole 131*b*, and the contact of a limit switch 132 (described later) disposed to a bottom portion of the hole 131*b* is closed.

There is another limit switch which is not shown in the drawings behind the photosensitive opening 125, and therefore, as the photosensitive cartridge is attached to the main body of the apparatus, the contact of this limit switch is closed. With respect to this limit switch, it is desirable that the contact of the limit switch is closed when the photosensitive cartridge 2 is attached perfectly correctly to the main body of the apparatus, but is not closed when the photosensitive cartridge is attached imperfectly. This is because it is necessary to detect that the photosensitive cartridge is attached securely, so that the developer unit 4 will not be rotated while the photosensitive cartridge is attached imperfectly and the apparatus will not get accordingly damaged.

In this image forming apparatus 1, as for each one of the external cover 120 and the internal cover 130, from the state of the contact of each corresponding limit switch, it is possible to learn whether each cover is open or close. In addition, it is possible to find whether the photosensitive cartridge 2 has been attached or not. This apparatus is structured so that the image forming operation is executed only when the external cover 120 and the internal cover 130 are closed and the photosensitive cartridge 2 is attached.

Figure 4:
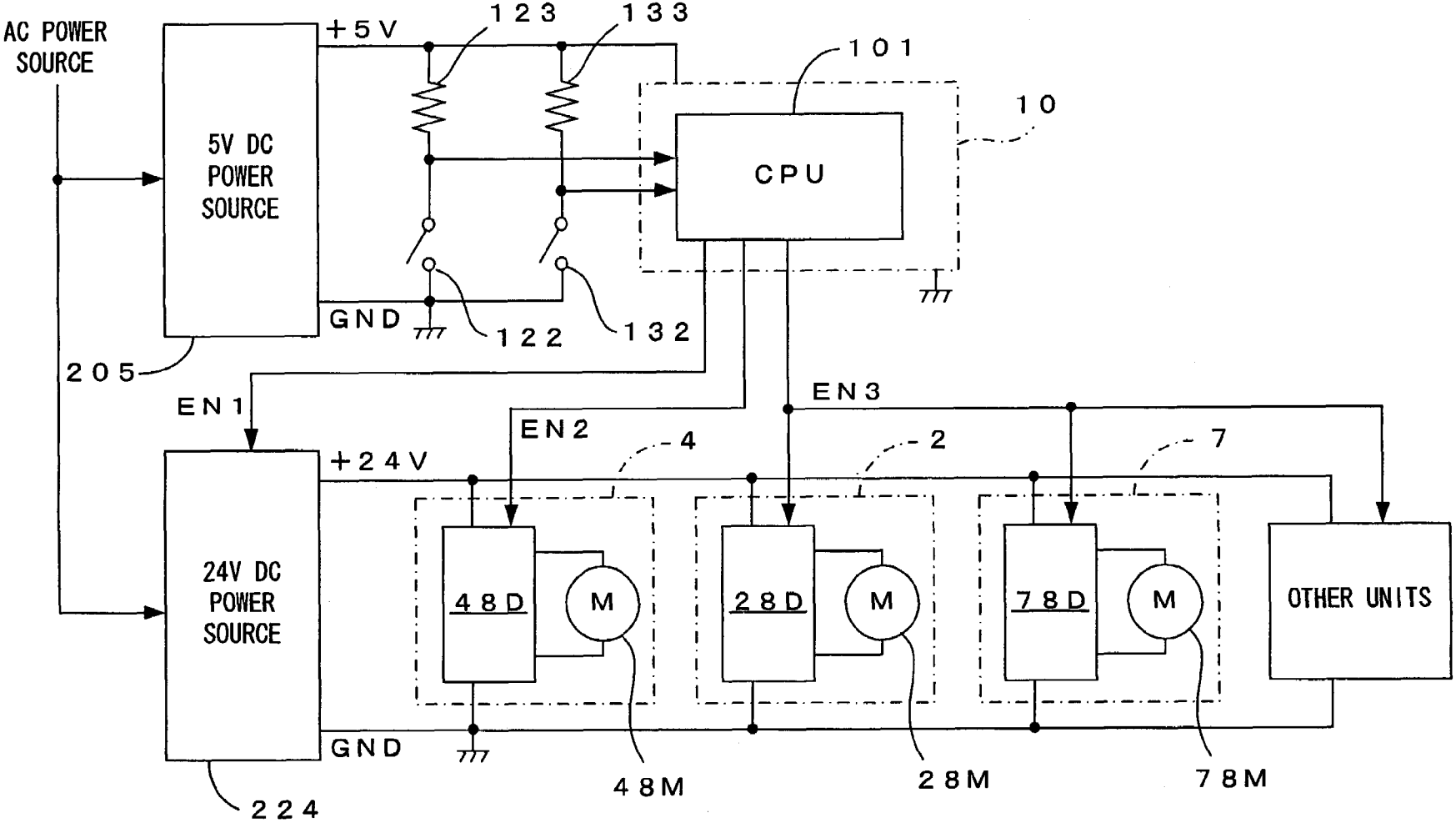
FIG. 4 is a block diagram which shows power supply routes in the image forming apparatus.

FIG. 4 is a block diagram which shows power supply routes in the image forming apparatus. The image forming apparatus 1 is designed to operate on utility AC power. Specifically, the apparatus 1 includes DC power sources 205 and 224 for converting the AC source voltage to a DC voltage of 5V and a DC voltage of 24V, respectively. An output voltage from the 5V DC power source 205 is supplied to control circuits for the engine controller 10 and the like. The foresaid limit switches 122, 132 are also supplied with the 5V DC voltage via pull-up resistors 123, 133, respectively and terminal voltages thereof are inputted to the CPU 101. That is, the CPU 101 determines the respective open positions or close positions of the outside cover 120 and the inside cover 130 by detecting the terminal voltages of these limit switches.

On the other hand, an output voltage from the 24V DC power source is supplied to power system loads such as motors for driving individual movable parts of the apparatus 1. Such loads include: a motor 48M for driving the developing unit 4 into rotation and a driver 48D thereof (rotary driver portion); a motor 28M for driving the photosensitive member 22 into rotation and a driver 28D thereof; a motor 78M for driving the roller 75 of the transfer unit 7 into rotation thereby rotating the intermediate transfer belt 71 and a driver 78D thereof; and the like.

The CPU 101 is also adapted to output three kinds of enable control signals EN1, EN2, EN3. These control signals EN1 through EN3 are inputted to respective units for switching the respective units between an operative state and an inoperative state. For instance, when the control signal EN1 inputted to the 24V DC power source 224 is at H-level, the power source 224 is activated. When the control signal EN1 is at L-level, the power source 224 is deactivated. Similarly, the driver 48D is switched between the operative state and the inoperative state as controlled by the control signal EN2, whereas the drivers 28D, 78D and other units operating on the 24V power source are individually switched between the operative state and the inoperative state as controlled by the control signal EN3. In this manner, the CPU 101 is able to shift the individual units to the inoperative state on an as-needed basis. Hence, only a required unit may be placed in the operative state whereby an unnecessary operation of the apparatus may be inhibited or the power consumed by the overall apparatus may be reduced.

Figure 6:
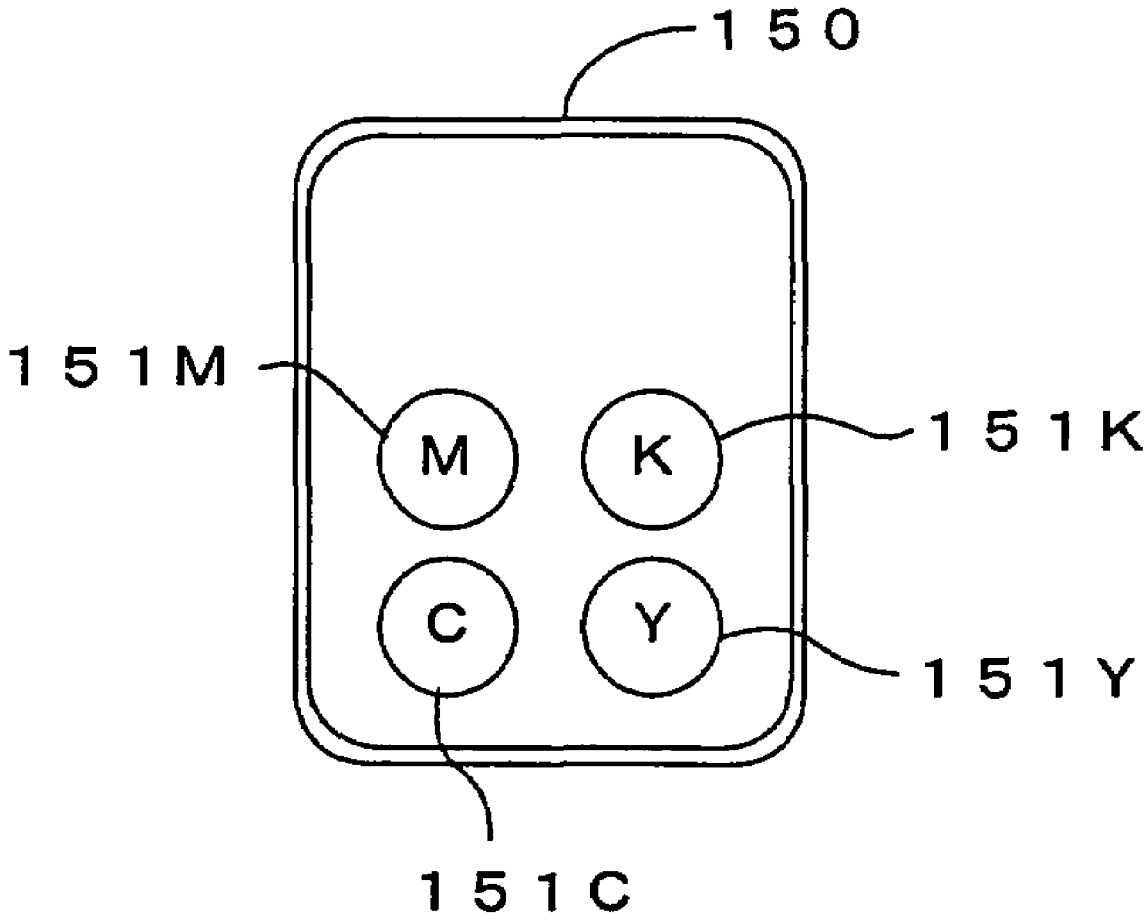
FIG. 6 is a drawing which shows a developer operation portion of the image forming apparatus.

Next, an operation of mounting/dismounting the developer in/from the image forming apparatus is more specifically described with reference FIG. 5 and FIG. 6. FIG. 5 is a group of schematic diagrams which show stop positions of the developer cartridge. FIG. 6 is a drawing which shows a developer operation portion of the image forming apparatus. While the description is made here on a developer replacement operation by the user or the operation wherein the developer mounted in the image forming apparatus is dismounted therefrom and a fresh developer is mounted therein, the dismounting operation and the mounting operation are essentially the same.

In this image forming apparatus, the developing unit 4 is positioned and locked at any of the three positions shown in FIG. 5 by means of the engine controller 10 and an unillustrated rotary locking mechanism. The three positions include: (a) a home position; (b) a development position; and (c) a mounting/dismounting position. Of these, (a) the home position is a position at which the developing unit is positioned when the image forming apparatus 1 is in a standby state where the image forming operation is not performed. In this position, as shown in FIG. 5A, the developing rollers 44 disposed at the individual developers 4Y and such are all spaced away from the photosensitive member 22, and any one of the developers cannot be dismounted via the developer opening 135 formed in the apparatus body.

(b) The development position is a position at which the developing unit is positioned when the electrostatic latent image on the photosensitive member 22 is visualized with a toner of a selected color. As shown in FIG. 5B, the developing roller 44 disposed at one developer (the yellow developer 4Y in the figure) is positioned opposite the photosensitive member 22 and is applied with a predetermined developing bias, whereby the electrostatic latent image is visualized with the toner. When the developing unit is positioned at this development position, as well, it is impossible to dismount any one of the developers via the developer opening 135. In a case where the outside cover 120 is opened during the image forming operation, the image forming operation is immediately terminated while the developing unit 4 is moved to the home position and halted there.

In the development position, a connector disposed at one of the developers mounted in the developing unit 4 (a connector 49C of the cyan developer 4C in the figure) is positioned opposite a connector 109 of the apparatus body, as shown in FIG. 5B. In this state, the connector 109 of the apparatus body is moved to the developer to establish a fitting engagement between these connectors, so that the CPU 101 is allowed to access the memory 92 or such on the developer side. This embodiment requires a step of drivably rotating the developing unit 4 to the development position and locking the same at the development position prior to the execution of communications between the memory 91 or such of the individual developers 4Y and such and the CPU 101.

The accesses to the individual memories made by the CPU 101 are limited to the minimum necessary number in order to extend the service life of the apparatus by reducing the wear of the connector 109 and the like. Specifically, the following method is taken. When a fresh developer is mounted in the developing unit 4, information stored in a memory of the developer of interest is retrieved and stored in the RAM 108 of the engine controller 10. As required, the information is updated according to the usage of the apparatus and then stored in the RAM. When the developer is to be dismounted, the latest information stored in the RAM 108 is written in the memory of the developer prior to the dismounting of the developer. Thus, the access to the memory of the developer need be made only when the developer is mounted and when the developer is dismounted.

(c) The mounting/dismounting position is a position that the developing unit can take only when the mounting/dismounting of the developer is carried out. When the developing unit 4 is positioned at the mounting/dismounting position, one of the developers appears at the developer opening 135, as shown in FIG. 5C, so that the developer may be dismounted via the opening 135. FIG. 5C depicts a state where the yellow developer 4Y appears at the developer opening 135. This state also permits a fresh developer to be mounted to the support frame 40 free of the developer. In this mounting/dismounting position, all the developing rollers 44 disposed at the individual developers are sufficiently spaced away from the photosensitive member 22. In this manner, the apparatus is designed to permit the dismounting of only one of the developers that appears at the developer opening 135 when the developing unit 4 is positioned at the mounting/dismounting position. This obviates a fear that the user may cause damage to the apparatus by inadvertently performing an improper mounting/dismounting of the developer.

In this image forming apparatus, the aforesaid development position and mounting/dismounting position are defined for each of the four developing devices 4Y, 4M, 4C, 4K and hence, the developing unit 4 has nine stop positions in total, inclusive of one home position.

In the image forming apparatus 1, as described above, the developing unit 4 is positioned at the home position in the standby state where the image forming operation is not performed. When the outside cover 120 is opened during the image forming operation, as well, the developing unit 4 is moved to and halted at the home position. Therefore, even if the user may open the outside cover 120 and then the inside cover 130 to expose the developer opening 135, the apparatus is not in such a state as to permit the dismounting of the developer immediately.

This image forming apparatus 1 permits the mounting/dismounting of the developer only after the user operates a developer operation portion 150 shown in FIG. 2 and FIG. 6 thereby to move the rotary developing unit 4 to the mounting/dismounting position. Specifically, when the user depresses any one of the replacement command buttons 151M, 151K, 151C and 151Y on the developer operation portion 150 that corresponds to a toner color of a developer which the user wants to replace, the developing unit 4 is positioned at the mounting/dismounting position as drivably rotated by a predetermined amount by means of the motor 48M controlled by the engine controller 10. Thus, the developer corresponding to the selected toner color is brought to the developer opening 135. Subsequently, the user opens the inside cover 130 with the developing unit 4 thus positioned at the mounting/dismounting position, and then performs the operation of dismounting/mounting the developer 4Y or such via the developer opening 135.

In the image forming apparatus 1 arranged as described above, the CPU 101 controls the individual parts of the apparatus for selectively executing any one of the following operation modes, which include: a normal operation mode to enable the image forming operation; a replacement operation mode to inhibit the image forming operation but to permit the developer mounting/dismounting operation; an all-disable mode to inhibit the image forming operation and the developer mounting/dismounting operation; and a power save mode to deactivate the 24V DC power source.

FIG. 7 is a table which shows correspondence between the individual operation modes and the set values of individual control signals. According to the apparatus operation mode to be executed, the CPU 101 sets the individual control signals EN1 through EN3 to the respective levels shown in FIG. 7. In each operation mode, a necessary unit is activated while an unnecessary unit is deactivated. In the power save mode of the operation modes, the 24V power source for energizing the individual units is deactivated. Therefore, the control signals EN2, EN3 in this mode may be at any level.

Figure 8:
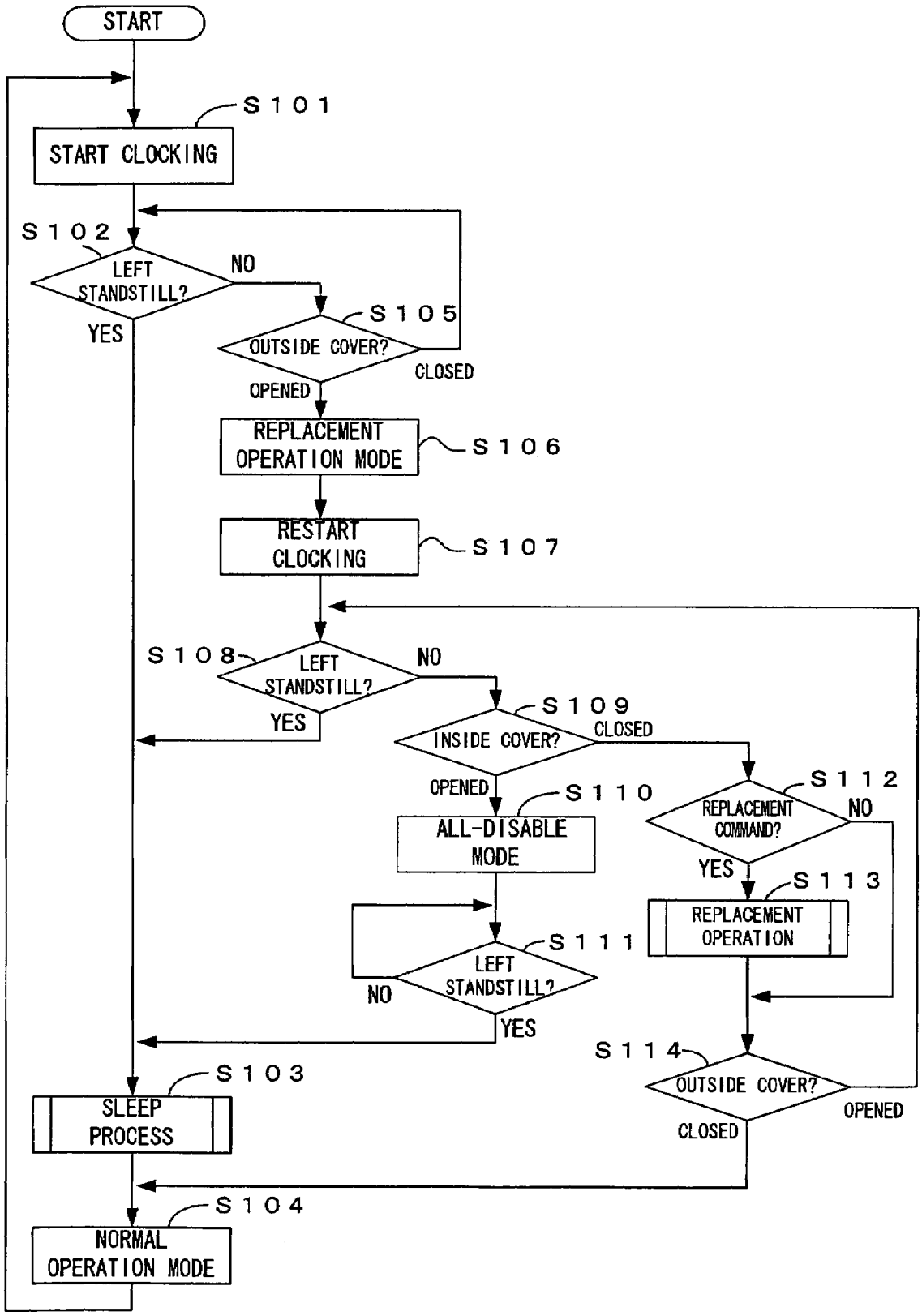
FIG. 8 is a flow chart which explains how the apparatus is shifted from one operation mode to another.
Figure 9:
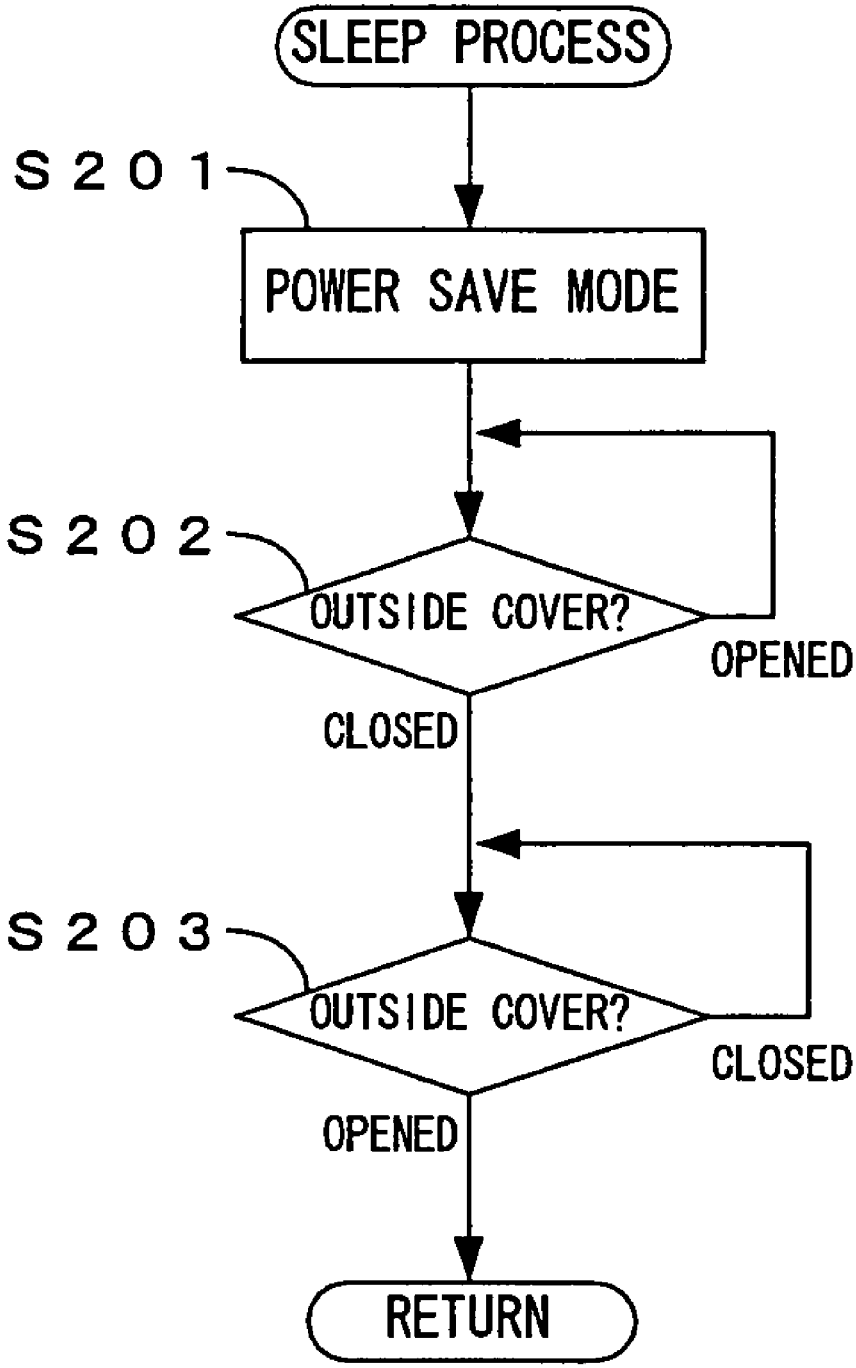
FIG. 9 is a flow chart which shows the steps of a sleep process.
Figure 10:
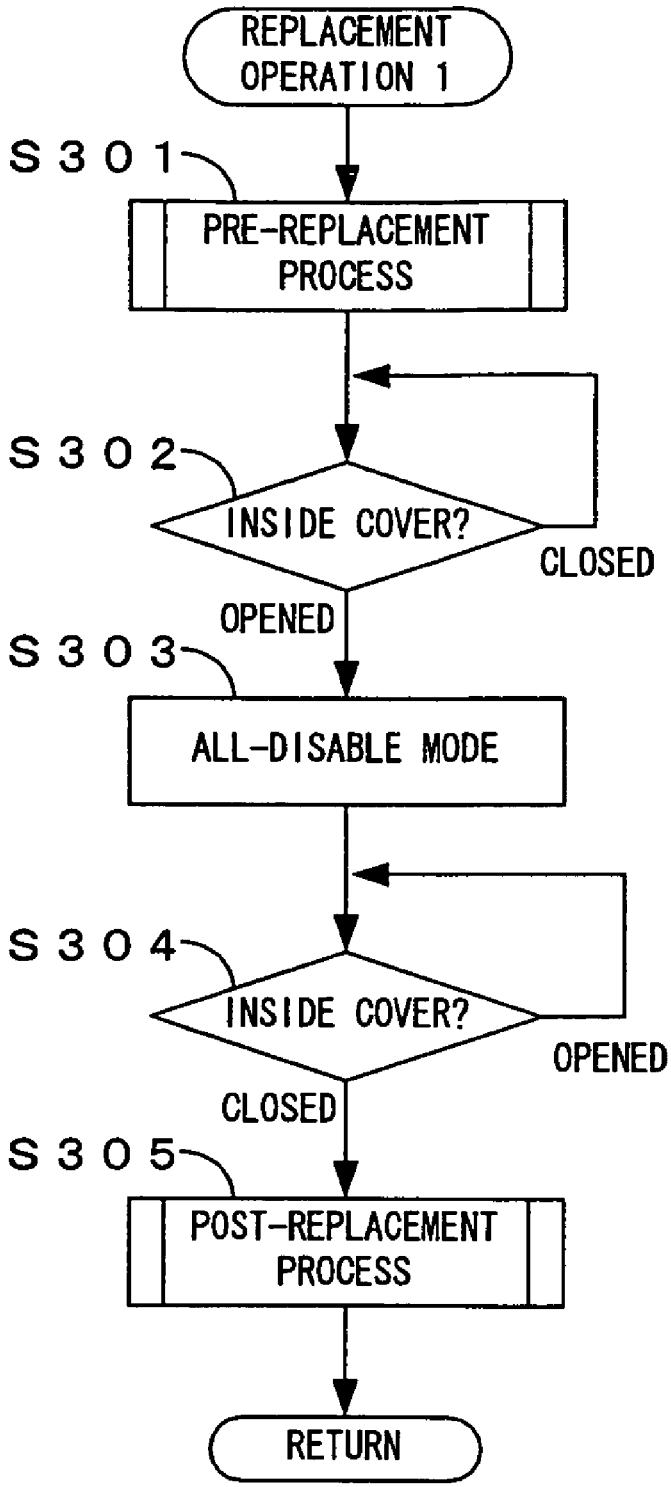
FIG. 10 is a flow chart which shows the steps of a first replacement operation.
Figure 11:
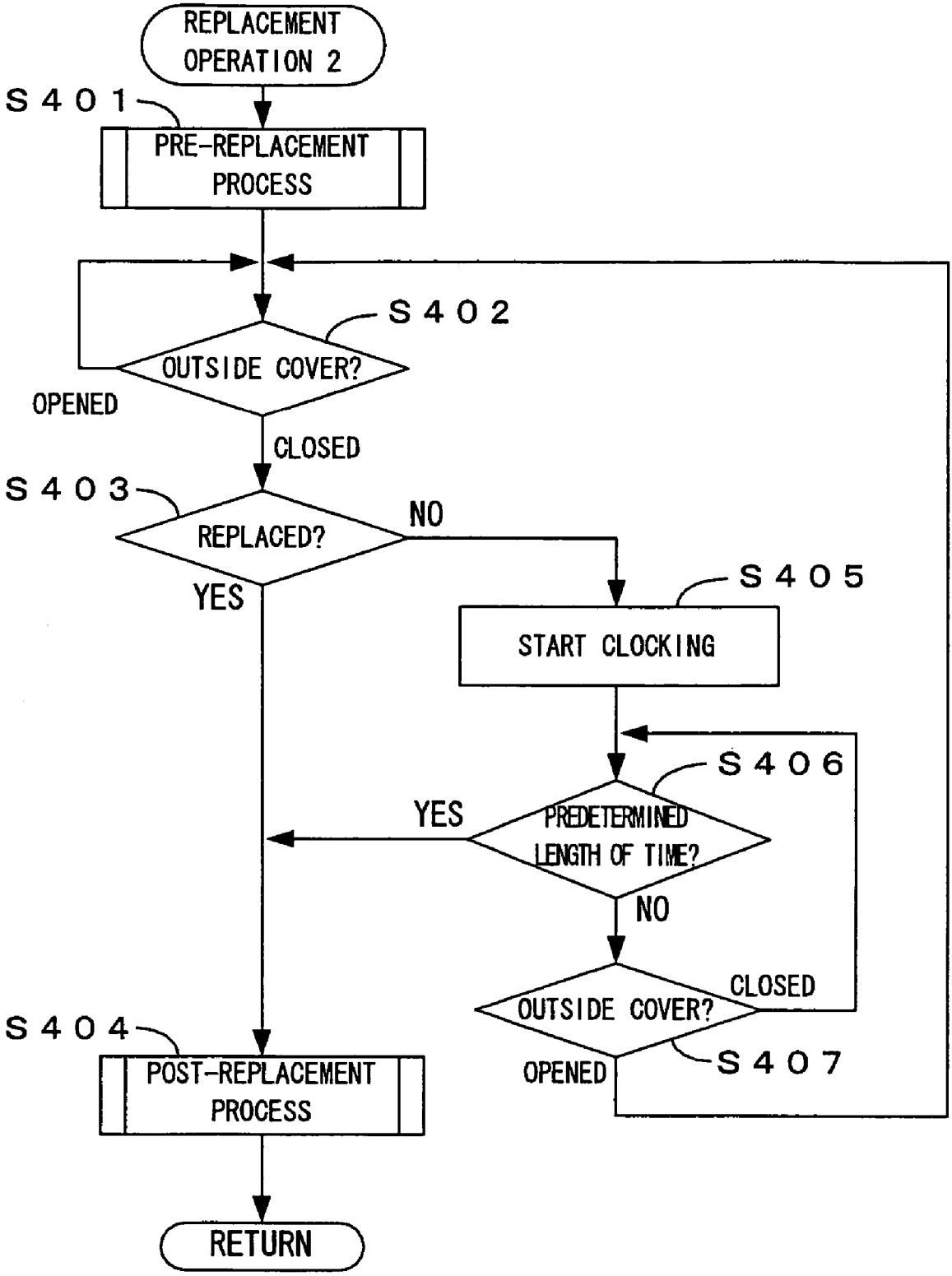
FIG. 11 is a flow chart which shows the steps of a second replacement operation.
Figure 12:
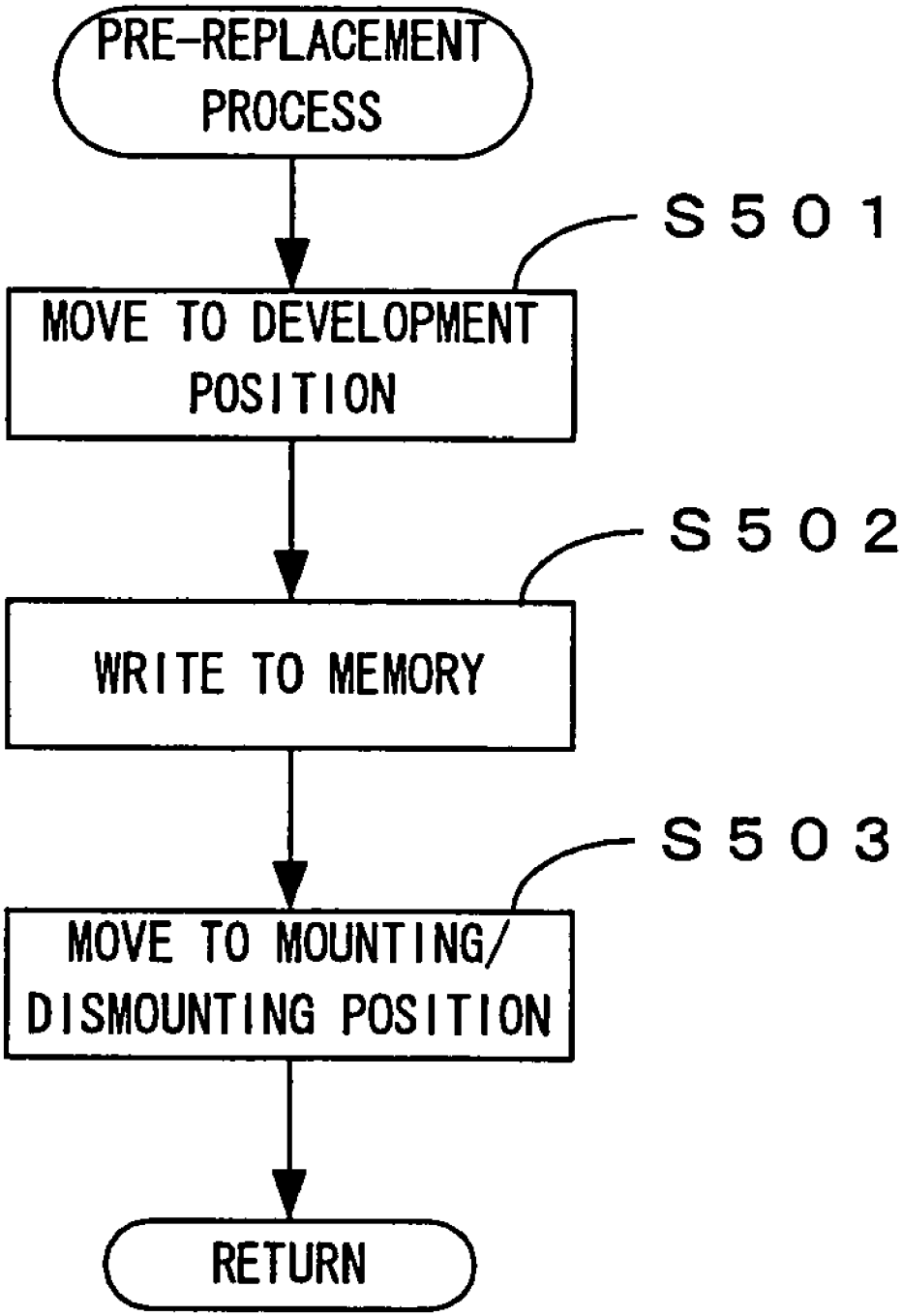
FIG. 12 is a flow chart which shows the steps of a pre-replacement process.
Figure 13:
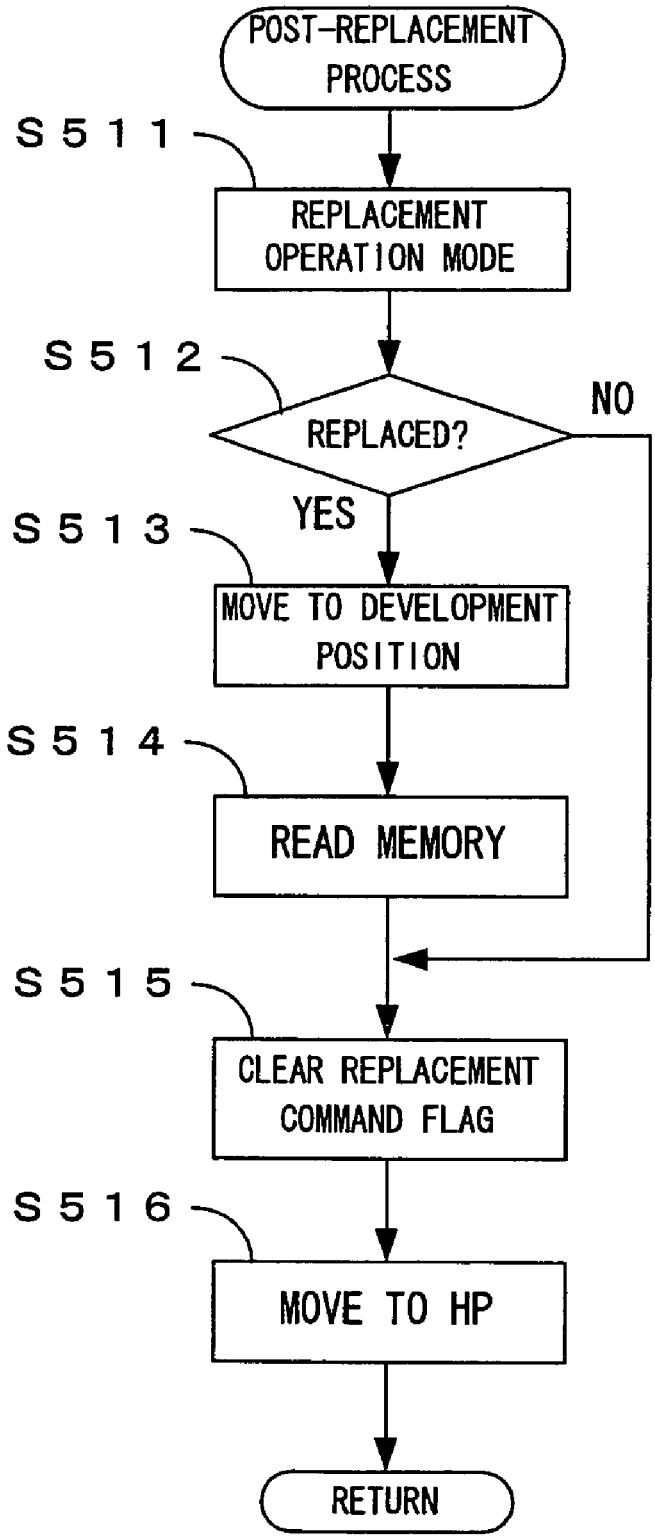
FIG. 13 is a flow chart which shows the steps of a post-replacement process.

FIG. 8 is a flow chart which explains how the apparatus is shifted from one operation mode to another. FIG. 9, FIG. 10 and FIG. 11 are flow charts which show the steps of a sleep process, a first replacement operation, and a second replacement operation, respectively. FIG. 12 and FIG. 13 are flow charts which show the steps of a pre-replacement process and a post-replacement process, respectively.

When applied with an image signal from an external apparatus, the apparatus 1 performs the image forming operation for forming an image corresponding to the image signal (normal operation mode). In a case where the apparatus is applied with no image signal for a predetermined length of time, the apparatus is shifted from the normal operation mode to the power save mode such as to reduce the power consumption of the apparatus. FIG. 8 illustrates operations performed by the CPU 101 in the case where a new image signal is not applied after completion of a series of image forming operations.

In the case where a new image signal is not applied after completion of the image forming operation, the CPU 101 starts clocking by means of an internal timer (Step S101), as shown in FIG. 8. Then, the CPU determines whether the clocking result reaches a predetermined length of time (say, 10 minutes) or not (Step S102). If the clocking result reaches the predetermined length of time, the CPU performs the sleep process to shift the apparatus to the power save mode (Step S103). The sleep process will be described hereinlater.

On the other hand, if it is determined in Step S102 that the clocking result is less than the predetermined length of time (immediately after completion of the image forming operation, for example), the CPU refers to the terminal voltage of the limit switch 122 to determine whether the outside cover 120 is opened or not (Step S105). If the outside cover 120 is closed at this time, the operation flow returns to Step S102. Accordingly, the CPU repeats the loop of steps S102 and S105 as continuing the clocking operation, until the clocking result reaches the predetermined length of time or the outside cover 120 is opened. If the outside cover 120 is opened during this time period, the apparatus is shifted to the replacement operation mode (Step S106). Specifically, the CPU 101 shifts the control signal EN3 to L-level, thereby disabling the operations of the individual parts of the apparatus, except for the control circuits, 24V power source 224 and the developing unit 4.

In the replacement operation mode, the developing unit 4 is allowed to rotate thereby permitting the developer mounting/dismounting operation, whereas the other units, such as the photosensitive member 22 and the transfer unit 7, are deactivated. Hence, the apparatus may consume less power than in the normal operation mode. Particularly, the apparatus can attain a more noticeable power saving effect by stopping power supply to a heater (not shown) of the fixing unit 9 which consumes a large amount of power in the normal operation mode. Since the image forming operation is not performed in the replacement operation mode, the exposure unit 6 and individual parts involved in sheet transport may also be deactivated in addition to the above parts thus deactivated. Thus, the power consumption may be further reduced.

In the replacement operation mode, however, the 24V power source 224 and the developing unit 4 are operative, so that the power consumption by these units still continues. There is no problem if the mode shift is immediately followed by the unit mounting/dismounting operation. However, if the apparatus is allowed to stand in this state where the outside cover 120 is opened, the associated power consumption may become considerable. In order to reduce the power consumed in such a case, the timer is reset to restart the clocking operation when the outside cover 120 is opened (Step S107). If the apparatus is allowed to stand in this state until a predetermined length of time has passed (Step S108), the sleep process (Step S103) is executed to shift the apparatus to the power save mode.

In this embodiment, the aforesaid "predetermined length of time" between the start of clocking operation and the start of sleep process may be of the same value in Step S102 and Step S108 or of different values. For instance, the "predetermined length of time" in Step S108 may be defined according to the length of time passed between the completion of the image forming operation and the shift to the replacement operation mode, such that the apparatus may be shifted to the power save mode after the passage of the substantially same length of time in both of the cases where the apparatus is shifted to the power save mode as skipping the replacement operation mode and where the apparatus is shifted to the power save mode via the replacement operation mode.

In the sleep process, the apparatus is first shifted to the power save mode (Step S201), as shown in FIG. 9. Specifically, the CPU 101 shifts the enable control signal EN1, applied to the 24V power source 224, from H-level to L-level, thereby deactivating the power source. Thus, the individual parts of the apparatus except for the control circuits are deactivated, so that the power consumed by these parts and the power source 224 is minimized.

In this state, the CPU 101 refers to the terminal voltage of the limit switch 122 to determine whether the outside cover 120 is opened or closed (Step S202). If the outside cover 120 is open, the operation of Step S202 is repeated until the cover is closed. If, on the other hand, the outside cover 120 is closed, the control flow proceeds to Step S203 to wait for the cover to be opened. When the cover is opened, the control flow returns to the main process shown in FIG. 8 to perform Step S104, so that the apparatus is shifted from the power save mode to the normal operation mode. That is, the power source 224 is reactivated while the individual parts of the apparatus are enabled to perform the image forming operation.

The series of processes change the status of the apparatus as follows during the execution of the power save mode. In a case where the apparatus with the outside cover 120 closed is shifted to the power save mode, the apparatus is maintained in the power save mode as long as the cover is closed (loop of Step S203). When the cover 120 is opened, the apparatus exits from the power save mode and is shifted to the normal operation mode. In a case where the apparatus with the outside cover 120 opened is shifted to the power save mode, the control flow waits for the cover to be closed once (loop of Step S202). Subsequently, the control flow waits for the cover to be opened again (loop of Step S202) to shift the apparatus to the normal operation mode. The reason for adopting this procedure will be described hereinlater.

Returning to Step S108 in FIG. 8, description is made on a process performed in a case where the predetermined length of time has not passed from the shift to the replacement operation mode. In this case, whether the inside cover 130 is opened or not is determined based on the terminal voltage of the limit switch 132 (Step S109). If the inside cover 130 is open, the apparatus executes the all-disable mode, during which the mounting/dismounting of the developer is inhibited because the developing unit 4 is not positioned at the mounting/dismounting position.

The all-disable mode aims at inhibiting the rotation of the developing unit 4 when the inside cover 130 is opened. In this respect, this mode differs from the aforementioned power save mode aiming at reducing the power consumption of the apparatus. In this mode, the CPU 101 deactivates the developing unit 4 by shifting the enable control signal, applied to the developing unit 4, to L-level. Alternatively, the rotation of the developing unit 4 may also be inhibited by means of a mechanical locking mechanism activated when the inside cover 130 is opened. In a case where, just as in the power save mode, the power source 224 is deactivated when the inside cover 130 is opened, it takes some time to reactivate the power source 224 and hence, the re-start of the developing unit 4 at the closure of the inside cover 130 is accordingly delayed. Consequently, the operation takes a longer time.

Even when the apparatus is thus placed in the all-disable mode, if the apparatus is left in as-is state for the predetermined length of time, the aforementioned sleep process is executed to shift the apparatus to the power save mode (Step S111).

On the other hand, if it is determined in Step S109 that the inside cover 130 is closed, determination is made as to whether any one of the replacement command buttons is depressed or not (Step S112). Specifically, when the user depresses any one of the buttons of the developer operation portion 150 (FIG. 6), a replacement command flag corresponding to the depressed button is set. Therefore, whether the button is depressed or not may be determined by checking the associated flag.

If it is determined that the replacement command button is not depressed, the control flow proceeds to step S114 and then, returns to Step S108 if the outside cover 120 is opened. On the other hand, if the outside cover 120 is closed, or if the outside cover 120 is closed after the shift to the replacement operation mode, it is determined that the operation by the user is completed. Hence, the apparatus is shifted to the normal operation mode (Step S104).

Now referring to FIG. 10 through FIG. 12, description is made on the replacement operation performed when the replacement command button is depressed. The apparatus performs either the first replacement operation shown in FIG. 10 or the second replacement operation shown in FIG. 11, as the replacement operation of Step S113 shown in FIG. 8.

In the first replacement operation (FIG. 10), the pre-replacement process (Step S301) is first carried out. The contents of the pre-replacement process are as shown in the flow chart of FIG. 12. Specifically, the developing unit 4 is moved to the development position (Step S501). Information indicative of use conditions of a developer of a selected toner color is written to a memory disposed in the developer of interest (Step S502). Subsequently, the developing unit 4 is moved and positioned at the mounting/dismounting position to permit the mounting/dismounting of the selected developer (Step S503). Thus, the user is allowed to open the inside cover 130 and to perform the mounting/dismounting operation of the developer.

Returning to FIG. 10, the apparatus in this state waits for the developer to be replaced by the user. In this embodiment, the replacement of the developer is determined to be done on the basis that the inside cover 130 covering the developer opening 135 is opened and then is closed again (Steps S302, S304). Subsequently, the post-replacement process (Step S305) is performed. It is noted that while the inside cover 130 is left open, the apparatus is placed in the all-disable mode such as to inhibit the rotation of the developing unit 4 (Step S303).

The contents of the post-replacement process are as shown in the flow chart of FIG. 13. Specifically, the apparatus is first shifted from the all-disable mode to the replacement operation mode, thereby enabling the drivable rotation of the developing unit 4 (Step S511). The subsequent Step S512 is a process to determine whether the developer replacement operation is done by the user or not. This step is significant for the second replacement operation to be described hereinlater. In the first replacement operation, the replacement operation is determined to be done by detecting the opening and closure of the inside cover 130, as described above. Therefore, the determination result of this step is always "YES" and hence, operations of the subsequent Steps S513 and such are performed. Specifically, the developing unit 4 is moved and positioned at the development position (Step S513). Information stored in a developer mounted afresh is retrieved (Step S514).

The information thus retrieved is stored in the RAM 108 of the engine controller 10. The CPU 101 may refer to the information thus stored and may update the contents of the information on an as-needed basis, thereby properly managing the operation histories of the individual developers. Thereafter, the replacement command flag is cleared (Step S515) and then, the developing unit 4 is moved to the home position (HP) (Step S516). Thus, a series of operations are completed.

In contrast, the second replacement operation (FIG. 11) is arranged as follows. First, the same pre-replacement process as that of the first replacement operation is performed (Step S401). Then, the control flow waits for the outside cover 120 to be closed by the user (Step S402). When the outside cover 120 is closed, determination is made as to whether the developer replacement is done by the user or not (Step S403). A determination basis used in this step is whether or not the operation of opening and closing the inside cover 130 is done at least once before the outside cover 120 is closed. That is, if the inside cover 130 is opened and closed during a period of time between the manipulation of the replacement command button and the closure of the outside cover 120, it may be determined that the replacement of the developer is done. If, on the other hand, the outside cover 120 is closed with the opening/closing of the inside cover 130 yet to be done, the replacement of the developer is undone. Such determinations may be accomplished by monitoring the terminal voltages of the limit switches 122, 132 disposed in correspondence to the respective covers.

In the case where the replacement of the developer is done or the opening/closure of the inside cover 130 is detected, the same post-replacement process as that of the first replacement operation is immediately carried out (Step S404). On the other hand, in the case where the outside cover 120 is closed with the developer replacement yet to be done or with the opening/closing of the inside cover 130 yet to be done, the post-replacement process is not performed immediately but is performed after the lapse of a predetermined length of time. Specifically, a clocking operation independent from the clocking operation for the determination of the apparatus standstill state (Step S101 in FIG. 8) is started afresh (Step S405). If the clocking result indicates the lapse of a predetermined length of time, say 5 seconds, the post-replacement process is performed (Step S406). On the other hand, if the outside cover 120 is opened again during the clocking operation, the control flow returns to Step S402 to wait for the outside cover 120 to be closed again (Step S407).

In the post-replacement process (FIG. 13) performed after the lapse of the predetermined length of time from the closure of the outside cover 120 with the developer replacement undone (determined as "YES" in Step S406), the determination result in Step S512 is "NO" because the developer is not replaced. In this case, the control flow skips Steps S513 and S514. Since the currently mounted developer is the developer initially mounted in the apparatus, the contents of the memory in the developer are already known to the apparatus and need not be retrieved afresh. Those described above are the contents of the second replacement operation.

While the above description is about how the status of the apparatus is shifted in the case where the apparatus is not applied with the image signal from the external apparatus, the apparatus operates differently in a case where a new image signal is applied from the external apparatus. Firstly, in a case where the image signal is applied to the apparatus in a state where the execution of the image forming operation may be enabled or where both of the outside cover 120 and the inside cover 130 are closed, the above control flow is immediately suspended to perform the operation for forming an image corresponding to the image signal. In a case where both of the covers are closed when an image signal is applied during the execution of the power save mode, for example, the CPU 101 outputs the enable control signals at H-level to the individual parts of the apparatus. Thus, the apparatus is returned from the power save mode to the normal operation mode, in which the operation for forming the image corresponding to the image signal is performed.

On the other hand, in a case where the image signal is applied to the apparatus in a state where either one of the covers is open, the image forming operation is disabled. Hence, the apparatus is maintained in the as-is state, while sending a predetermined notice to the external apparatus. The external apparatus, in turn, determines that the image forming apparatus 1 is unable to perform the image forming operation. Accordingly, the external apparatus may take a proper step such as to stop sending the image signal or to notify the user. Additionally, the same procedure may also be taken in a case where any necessary unit is not mounted in the apparatus although the covers are closed.

In short, the status changes of the image forming apparatus 1 may be summarized as follows.

(1) In a case where the apparatus in the normal operation mode is left standstill for the predetermined length of time (10 minutes in the above example) during which the image signal is not applied to the apparatus nor the operation by the user is not performed, the apparatus is shifted to the power save mode. The 24V power source 224 is deactivated in the power save mode so that the apparatus consumes less power.

(2) In a case where the image signal is applied to the apparatus when the normal operation mode or the power save mode is in execution whereas both of the outside cover 120 and the inside cover 130 are closed, the apparatus immediately operates in the normal operation mode to carry out the image forming operation.

(3) In a case where the outside cover 120 is opened while the normal operation mode is in execution, the apparatus is shifted to the replacement operation mode. In the replacement operation mode, the rotation of the developing unit 4 is permitted for facilitating the developer replacement operation by the user, whereas the other units are deactivated to inhibit the image forming operation. In a case where the apparatus is left standstill for the predetermined length of time from the shift to the replacement operation mode, the apparatus is shifted to the power save mode. Thus is reduced the power consumption while the apparatus is left standstill.

(4) In a case where the opening of the outside cover 120 is followed by the opening of the inside cover 130, the apparatus is shifted to the all-disable mode. Thus, the rotation of the developing unit 4 is inhibited. In a case where the apparatus in this state is further left standstill, the apparatus is shifted to the power save mode.

(5) The operation of the apparatus remains the same if the outside cover 120 is closed during the execution of the power save mode. However, the apparatus in the power save mode is returned to the normal operation mode when the outside cover is opened. Such an arrangement is made for the following reason.

The reason for arranging the apparatus to operate as described in the above paragraph (5) is as follows. It is thought that why the user opens the cover of the apparatus in the power save mode is because the user intends to conduct some operation on the apparatus. If the apparatus continues to be in the power save mode, however, the apparatus does not operate, failing to meet the intention of the user. Particularly in the apparatus according to the embodiment wherein the mounting/dismounting of the developer is enabled by driving the developing unit 4, the apparatus may desirably exit from the power save mode when the cover is opened, so as to be placed in a state to permit some operations or at least the unit replacement operation. On the other hand, in a case where the outside cover 120 is closed during the execution of the power save mode, the apparatus need not necessarily exit from the power save mode. This is because so long as the cover is closed, another operation (such as input of an image signal from the external apparatus) may cause the apparatus to return to the normal operation mode. The apparatus need not necessarily take some action in response to a mere event that the cover left open is closed.

Hence, the apparatus is designed to remain in the as-is state when the outside cover 120 is closed during the execution of the power save mode, but to be returned to the normal operation mode when the outside cover 120 is opened. Thus, the apparatus is able to perform quickly an operation desired by the user. It is noted that at least the rotation of the developing unit 4 must be enabled for permitting the mounting/dismounting of the developer when the outside cover 120 is opened. However, the apparatus need not permit the image forming operation to be performed with the cover left open. As long as the outside cover is open, the apparatus is designed to be shifted to the replacement operation mode immediately after return to the normal operation mode, thus permitting the replacement operation of the developer or the like.

In a case where the second replacement operation shown in FIG. 1 is adopted as the replacement operation (Step S113) of FIG. 8, the apparatus performs the following operation additionally to the above operations (1) to (5).

(6) In a case where the manipulation of the replacement command button is followed by the closure of the outside cover 120, the post-replacement process such as to retrieve the contents of a memory in a fresh developer is performed immediately if it is determined that the replacement of the developer (more precisely, the opening and closing of the inside cover 130) is done before the closure of the outside cover. On the other hand, in a case where the outside cover 120 is closed with the opening/closing of the inside cover 130 yet to be done, the post-replacement process is performed after the lapse of a predetermined length of wait time (five seconds in the above example). Such an arrangement is made for the following reason.

The operation of depressing the replacement command button is done by the user intending to replace the developer. In some case, however, the user may mistakenly close the outside cover 120 without performing the mounting/dismounting of the developer. In such a case, the apparatus is not in a state to permit the user to dismount (or mount) the developer immediately after opening the cover again, if the post-replacement process is performed each time the outside cover is closed. Hence, the user must start the operation all over again. According to the embodiment, on the other hand, a proper wait time is provided between the closure of the outside cover 120 and the start of the post-replacement process, such that the apparatus may be maintained in the state to permit the mounting/dismounting of the developer if the user, noticing the operation error, immediately opens again the outside cover 120 once closed. Thus, the aforementioned problem may be obviated.

In a case where the replacement of the developer is done, it is unnecessary to provide such a wait time. What is more, the user may be frustrated at that the apparatus does not operate immediately. Therefore, in a case where it may be considered that the mounting/dismounting of the developer is done, or specifically where the operation of opening and closing the inside cover 130 is done by the user in the state where the mounting/dismounting of the developer is permitted (or the state where the developing unit 4 is positioned at the mounting/dismounting position), the post-replacement process is performed immediately after the closure of the outside cover 120. It is preferred that a wait time in this case is at least shorter than the wait time of the case where the opening/closing of the inside cover 130 is not detected.

There may also be a case where since the user does not intend to replace the developer, the user closes the outside cover 120 without performing the mounting/dismounting of the developer. Therefore, in a case where the outside cover 120 stays closed for a certain length of time, it is still preferred to perform the post-replacement process. Too short a wait time between the closure of the cover and the start of operation is inadequate as a provision against the operation error. Conversely, too long a wait time delays the subsequent operations. Therefore, the start waiting time may preferably be on the order of several seconds.

As described above, the image forming apparatus of the embodiment is adapted to execute not only the normal operation mode to enable the image forming operation and the power save mode to deactivate the principal parts of the apparatus, but also the replacement operation mode which is executed upon opening of the outside cover 120 so as to permit the drivable rotation of the developing unit 4. Therefore, the user can operate the apparatus with the outside cover 120 opened for rotatably moving the developing unit 4 to the mounting/dismounting position, so as to perform the developer mounting/dismounting operation. In this manner, the apparatus offers high user convenience in performing the developer mounting/dismounting operation.

Furthermore, if the apparatus is left standstill for the predetermined length of time from the shift to the replacement operation mode, the apparatus is shifted to the power save mode wherein the power consumption is further reduced. Hence, the apparatus may reduce wasteful power consumption when the apparatus is left standstill. Particularly, the 24V power source 224 for high power supply is deactivated, so that the power consumption may be minimized.

Furthermore, the image forming apparatus of the embodiment is shifted to the power save mode to further reduce the power consumption if the apparatus, as applied with no image signal, is left standstill for the predetermined length of time. Therefore, the apparatus can reduce the wasteful power consumption when left standstill. Particularly, the 24V power source 224 for high power supply is deactivated, so that the power consumption in the power save mode may be minimized. The power save mode is executed not only in the case where the apparatus is left standstill in the state where the outside cover 120 is closed and the image forming operation is enabled, but also in the case where the apparatus with the outside cover opened is left standstill.

Meanwhile, even when the power save mode is in execution, the apparatus cancels the power save mode quickly responding to the detection of the opening of the outside cover 120, and is shifted to the normal operation mode or the replacement operation mode so as to permit the drivable rotation of the developing unit 4. Hence, the apparatus may quickly respond to the manipulation of the replacement command button by the user, moving the developing unit 4 to the predetermined position. As a result, the user may highly efficiently perform the developer mounting/dismounting operation.

In the image forming apparatus of the embodiment, the state to permit the mounting/dismounting of the developer 4Y or such is established by taking the steps of opening the outside cover 120 and manipulating the replacement command button 151Y or such of the developer operation portion 150. More specifically, the state where the developing unit 4 is positioned at the mounting/dismounting position is established by taking the above steps. When the apparatus is in this state, the user is allowed to open the inside cover 130 to carry out the operation of mounting/dismounting the developer 4Y or such. When the outside cover 120 is closed in this state, the apparatus performs the post-replacement process to rotate the developing unit 4 thereby inhibiting the mounting/dismounting of the developer. In this process, the wait time between the closure of the outside cover and the start of the post-replacement process is designed to vary depending upon whether or not the mounting/dismounting of the developer is done before closure of the outside cover 120. More specifically, the post-replacement process is performed immediately if the outside cover 120 is closed after completion of the mounting/dismounting of the developer. On the other hand, if the outside cover 120 is closed with the mounting/dismounting of the developer yet to be done, the post-replacement process is started after the lapse of the wait time on the order of five seconds. Whether the mounting/dismounting of the developer is done or not is determined based on whether the opening/closing of the inside cover 130 is done or not.

The following working effects may be attained by making such arrangements. Firstly, in the case where the outside cover 120 is closed after completion of the mounting/dismounting of the developer, the apparatus may immediately start operating to perform the next operation such as the image forming operation. On the other hand, even if the user mistakenly closes the outside cover 120 without performing the mounting/dismounting of the developer, the post-replacement process is not started immediately. Therefore, if the user opens again the outside cover 120 during the wait time, the post-replacement process is not performed so that the apparatus is maintained in the state just before the closure of the cover. That is, the developing unit 4 remains halted at the mounting/dismounting position, so that the user may start the mounting/dismounting operation immediately.

As described above, each of the developers 4Y, 4M, 4C, 4K according to the embodiment is equivalent to the "process unit" of the invention. The developing unit 4 is mounted with these developers and is positioned at the mounting/dismounting position or any other position, thereby switching the apparatus between the state to permit the mounting/dismounting of the developer and the state to inhibit the mounting/dismounting of the developer. This developing unit 4 functions as the "development rotary" and the "switching unit" of the invention. The driver 48D and the motor 48M for driving the developing unit 4 into rotation are equivalent to the "driver" of the invention. The engine controller 10 or more specifically, the CPU 101 for controlling the operations of these parts functions as the "controller" of the invention. The outside cover 120 covering the engine EG is equivalent to the "cover member" of the invention. The developer operation portion 150 including the replacement command buttons 151Y and such for the respective toner colors is equivalent to a "command input unit" of the invention.

Out of the individual parts of the apparatus, the photosensitive member 22 is equivalent to a "latent image carrier" of the invention. The driver 28D and the motor 28M for driving the photosensitive member into rotation are equivalent to a "latent-image carrier driver" of the invention. The intermediate transfer belt 71 is equivalent to an "intermediate transfer member" of the invention. The driver 78D and the motor 78M for driving the intermediate transfer belt into rotation are equivalent to an "intermediate transfer member driver" of the invention. The power source 224 for supplying power to these members is equivalent to a "power source" of the invention.

Further according to the embodiment, the inside cover 130 covering the developer opening 135 as a "mounting/dismounting opening" of the invention functions as a "restricting member" for restricting the mounting/dismounting of the developer. The limit switch 132 for detecting the opening/closing of the inside cover functions as a "detector" of the invention. The memories 91 to 94 disposed in the respective developers 4Y and such each function as a "storage unit" of the invention. In this embodiment, the post-replacement process (FIG. 13) performed in the replacement operation (FIG. 10) is equivalent to a "mounting/dismounting inhibition process" of the invention.

Out of the operation modes of the embodiment, the replacement operation mode is equivalent to a "first standby mode" of the invention, whereas the power save mode is equivalent to a "second standby mode" thereof. The all-disable mode of the embodiment means a state where the developing unit 4 is temporarily deactivated in order to inhibit the developing unit 4 from rotating with the inside cover 130 opened. Hence, the all-disable mode is not included in the "operation modes" of the invention. The inside cover is not an essential component of the invention. In a case where the inside cover is not provided, the "all-disable mode" may also be omitted. However, in the case where the inside cover is provided as illustrated by the embodiment, the apparatus may preferably be arranged such that the two states to permit and to inhibit the rotation of the developing unit 4 may be implemented according to the opening and closure of the inside cover.

Second Preferred Embodiment

Figure 14:
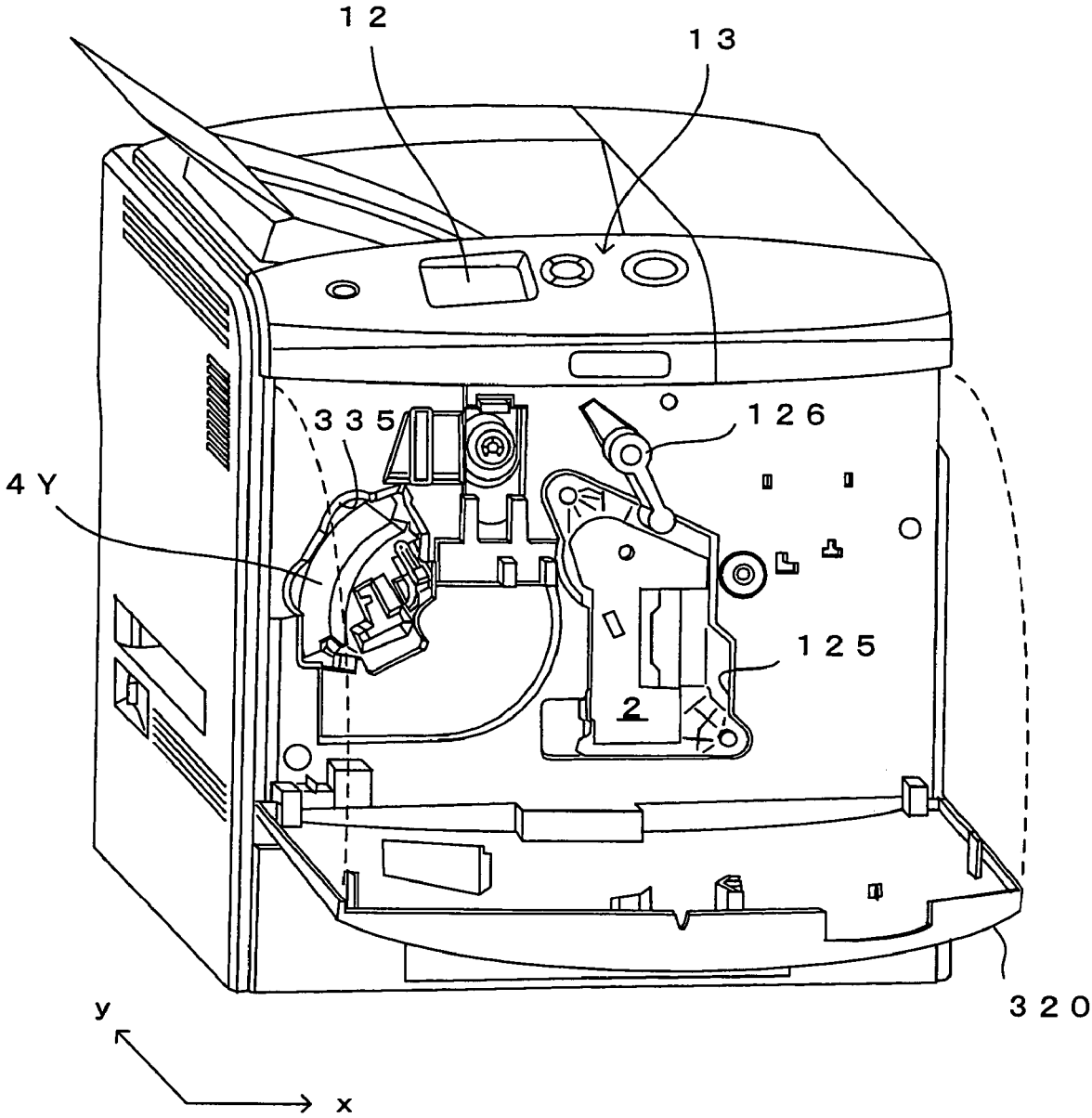
FIG. 14 is a drawing which shows an outside appearance of an image forming apparatus according to a second embodiment of the invention.

FIG. 14 is a drawing which shows an outside appearance of an image forming apparatus according to a second embodiment of the invention. A major difference between the apparatus of the second embodiment and the apparatus of the first embodiment consists in that the apparatus of the second embodiment is not provided with the inside cover for covering the developer opening. Accordingly, the apparatus of the second embodiment omits the arrangement for detecting the opening/closing of the inside cover. Otherwise, this apparatus is constructed substantially the same way as the apparatus of the first embodiment and hence, like parts are represented by the same reference characters, respectively, the description of which is dispensed with. Since an outside cover 320 and a developer opening 335 according to the second embodiment have different configurations from those of the corresponding components, the outside cover and the developer opening are represented by different reference characters.

In the apparatus of the embodiment, the developer operation portion 151 provided in the apparatus of the first embodiment is replaced by an operation portion 13 for accepting a replacement command from the user, which is disposed on a front side of an upper panel of the apparatus. Likewise to the developer operation portion 151 of the apparatus of the first embodiment, the operation portion 13 functions as the "command input unit" of the invention. According to the embodiment, when the user performs a predetermined operation to input a replacement command to the operation portion 13 in a state where the outside cover 320 is closed, the developing unit 4 is rotated to the mounting/dismounting position. The rotation of the developing unit 4 is inhibited till the outside cover 320 is closed. The following description is made on some of the operations of the apparatus of the second embodiment, that are different from those of the first embodiment described in the foregoing.

Figure 15:
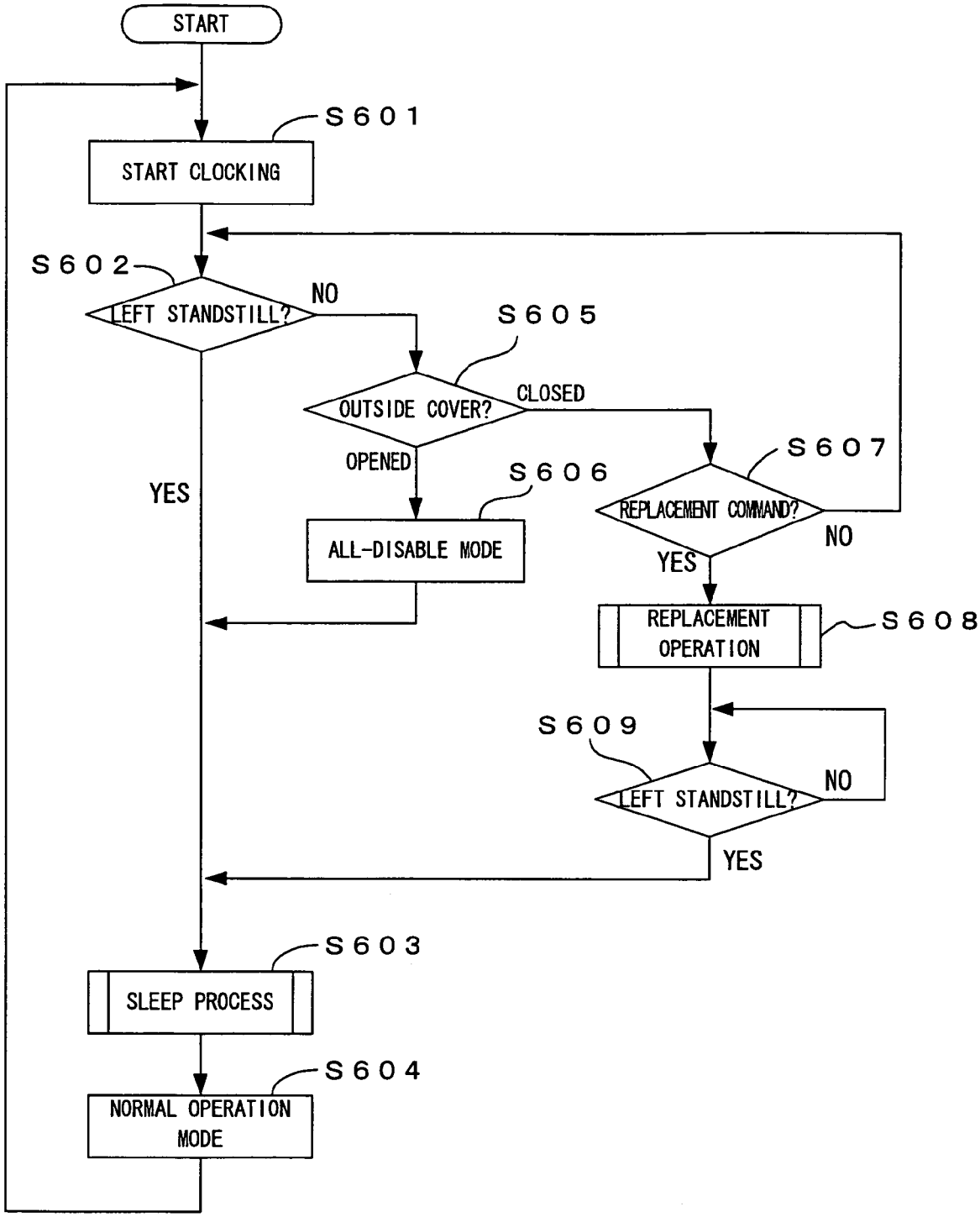
FIG. 15 is a flow chart which illustrates how the apparatus of the second embodiment is shifted from one operation mode to another.

FIG. 15 is a flow chart which illustrates how the apparatus of the second embodiment is shifted from one operation mode to another. In the cases where the opening/closing of the cover is not performed by the user and where the replacement command is not inputted by the user, essentially the same operations as those of the first embodiment are performed (Steps S601 through S604). However, the contents of the sleep process (Step S603) are different because of the difference in the arrangement of the apparatus. According to the embodiment, the apparatus is shifted to the all-disable mode immediately after the outside cover 320 is opened by the user, thus inhibiting the rotation of the developing unit 4 (Steps S605, S606). In this state, therefore, the user is not allowed to perform the developer mounting/dismounting operation. On the other hand, while the outside cover is closed, the apparatus is always waiting for a replacement command to be inputted by the user (Step S607). Upon acceptance of the replacement command, the apparatus performs a replacement operation to be described hereinlater (Step S608).

Figure 16:
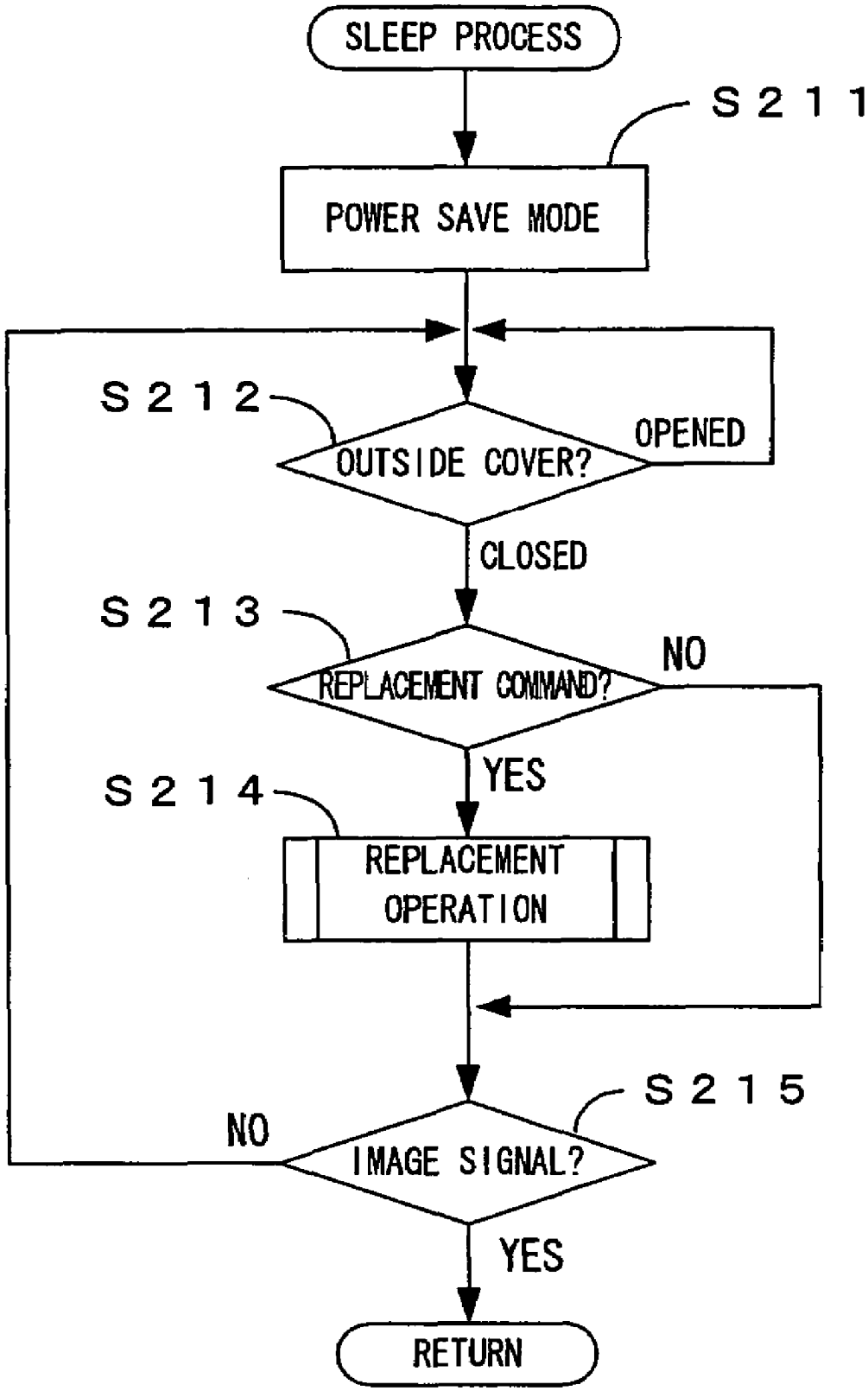
FIG. 16 is a flow chart which shows the steps of the sleep process according to the second embodiment.

FIG. 16 is a flow chart which shows the steps of the sleep process according to this embodiment. As described above, the embodiment permits the mounting/dismounting of the developer only when the user inputs the replacement command to the operation portion 13 in the state where the outside cover 320 is closed. In the sleep process according to the embodiment, once the outside cover 320 is opened after the apparatus is shifted to the power save mode (Step S211), the state of the apparatus remains unchanged until the outside cover is closed again (Step S212). If the replacement command is applied from the user in the state where the cover is closed (Step S213), the replacement operation is performed (Step S214). When applied with the image signal from the external apparatus, the image forming apparatus exits from the power save mode to return to the normal operation (Step S215). Otherwise, the apparatus remains in the power save mode.

Figure 17:
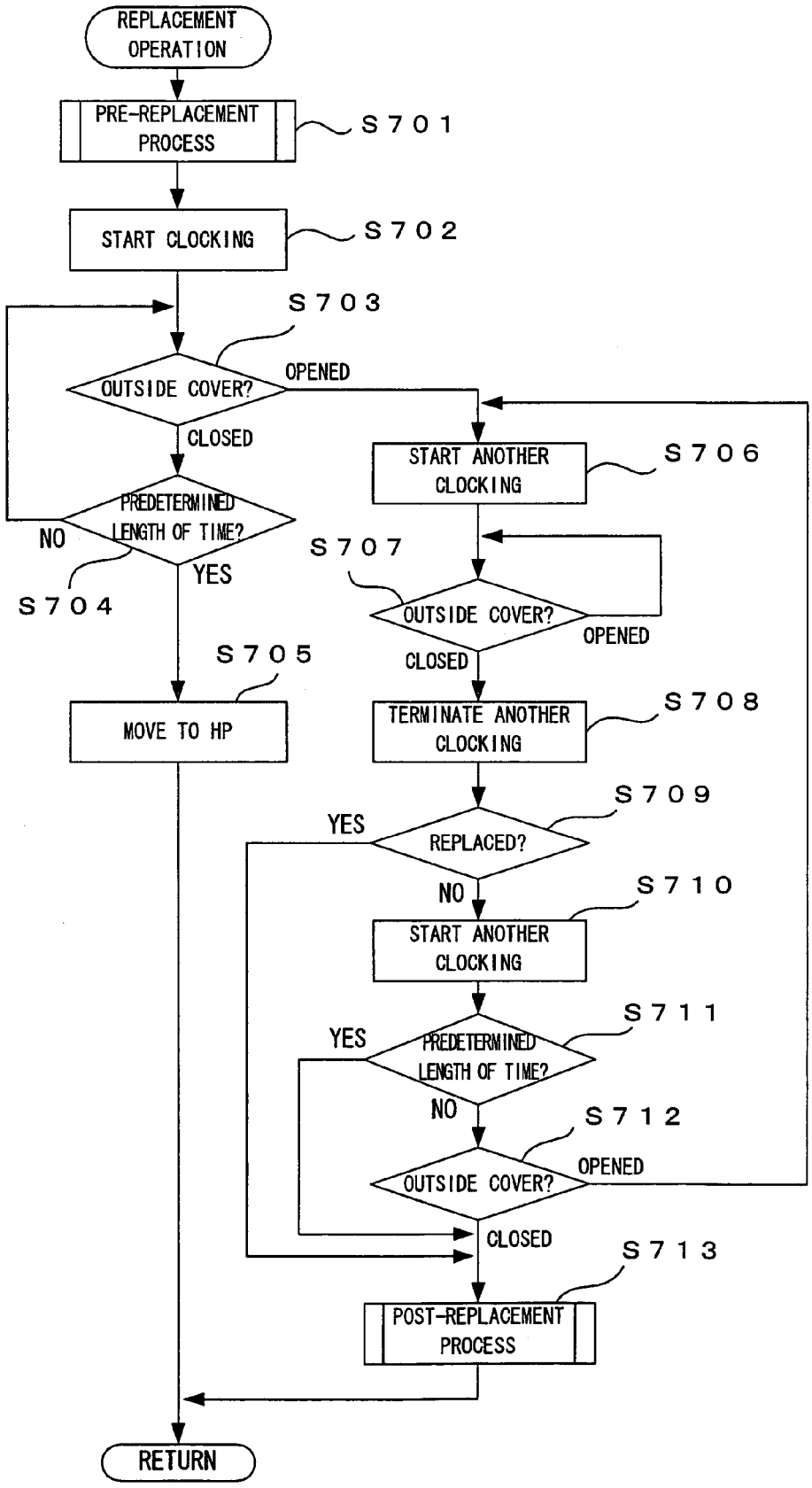
FIG. 17 is a flow chart which shows the steps of a replacement operation according to the second embodiment.

FIG. 17 is a flow chart which shows the steps of a replacement operation according to the embodiment. Accepting the replacement command from the user, the apparatus performs the pre-replacement process (FIG. 12) so as to move the developing unit 4 to the mounting/dismounting position, just as the apparatus of the first embodiment (Step S701). Then, the internal timer starts clocking (Step S702). In this state, the apparatus waits for the outside cover 320 to be opened (Step S703). If the outside cover 320 is not opened after the lapse of a predetermined length of time, the apparatus returns the developing unit 4 to the home position, regarding the replacement operation to be cancelled (Step S705).

On the other hand, if the outside cover 320 is opened, another clocking operation is started by means of a timer different from the above timer (Step S706). The clocking operation is continued while the outside cover 320 stays open. The clocking operation is terminated at the time when the outside cover 320 is closed (Steps S707, S708). Thus, the length of time during which the outside cover 320 stays open is determined. Based on the clocking result, determination is made as to whether the developer is replaced or not (Step S709).

The apparatus of the first embodiment determines whether the replacement operation is done or not by checking whether the opening/closing of the inside cover is done or not. In contrast, the apparatus of the second embodiment dispensing with the inside cover refers to the above clocking result or the length of time during which the outside cover 320 stays open, thereby determining whether the replacement operation is done or not. Specifically, the developer replacement operation takes a certain length of time and hence, it may be determined that the replacement operation is not done if the length of time during which the outside cover 320 stays open is shorter than the time required to accomplish the operation. If the outside cover 320 is opened and closed again several seconds later, for example, it is not thought that the developer replacement operation is accomplished during this period of time. On the other hand, if the outside cover 320 stays open for a sufficient length of time, it is most likely that the developer replacement operation is done during this period of time. Accordingly, the embodiment determines the replacement operation to be undone if the length of time during which the outside cover 320 stays open, as determined by the internal timer, is less than a predetermined value (say, 10 seconds). On the other hand, if the cover stays open for a longer time period than this value, the replacement is determined to be done.

When it is determined that the replacement of the developer is done, the post-replacement process is performed immediately (Step S713). The contents of the post-replacement process are the same as those of the first embodiment (FIG. 13). On the other hand, when the replacement operation is determined to be undone, another clocking operation is started (Step S710). After the lapse of a predetermined length of time (Step S711), the post-replacement process is performed. It is noted here that the "predetermined length of time" means the same as the "start waiting time" of the first embodiment. That is, the predetermined length of time is a wait time provided for the sake of relieving the operation error committed by the user. In a case where the outside cover 320 is opened during the wait time (Step S712), the control flow returns to the process of Step S706.

In the image forming apparatus according to the embodiment, whether the developer replacement operation is done or not is determined based on the length of time during which the outside cover 320 stays open, the outside cover opened after the replacement command is inputted by the user. The time period between the closure of the outside cover 320 and the start of rotation of the developing unit 4 is varied according to the determination result. By doing so, the second embodiment may also achieve the same working effects as those offered by the apparatus of the first embodiment.

Third Preferred Embodiment

Next, description is made on an image forming apparatus according to a third embodiment of the invention. While the apparatus has the same mechanical construction as the above image forming apparatus of the second embodiment, the apparatus differs from that of the second embodiment in how the apparatus is shifted from one operation mode to another. A specific description is made on operation mode shifts which are characteristic of the third embodiment.

Similarly to the apparatuses of the foregoing first and second embodiments, the image forming apparatus of the embodiment positions the developing unit 4 at the home position when the apparatus is in the standby state where the image forming operation is not performed. Therefore, if the user opens the outside cover 320 to expose the developer opening 335, the user is not allowed to dismount the developer immediately.

In this image forming apparatus, the mounting/dismounting of the developer is not permitted until the user manipulates the operation portion 13 to operatively move the developing unit 4 to the mounting/dismounting position. Specifically, the user manipulates the buttons of the operation portion 13 according to a predetermined procedure or a procedure shown in a display unit 12 so as to input a command to mount/dismount any one of the developers or all the developers. In response to the input command, the CPU 111 sends a control command to the engine controller 10. Receiving this control command, the CPU 101 of the engine controller 10 controls the rotary developing unit 4 for positioning the developing unit 4 at the mounting/dismounting position corresponding to any one of the four developers. In this state where the developing unit 4 is positioned at the mounting/dismounting position, the user is allowed to open the outside cover 320 and to perform the operation of mounting/dismounting the developer 4Y or such via the developer opening 335. On the other hand, even if the user opens the outside cover 320 without manipulating the operation portion 13, the developing unit 4 is at the home position so that the mounting/dismounting of the developer is inhibited.

In the apparatus of the above arrangement, the CPU 101 and the CPU 111 controls the individual parts of the apparatus, thereby selectively executing any one of the following three operation modes, which include: an image forming mode to enable the image forming operation immediately after receipt of an image signal from the external source; a first power save mode to deactivate some parts of the apparatus in the standby state thereby reducing the power consumption; and a second power save mode to deactivate more parts of the apparatus than in the first power save mode thereby further reducing the power consumption.

Figure 18:
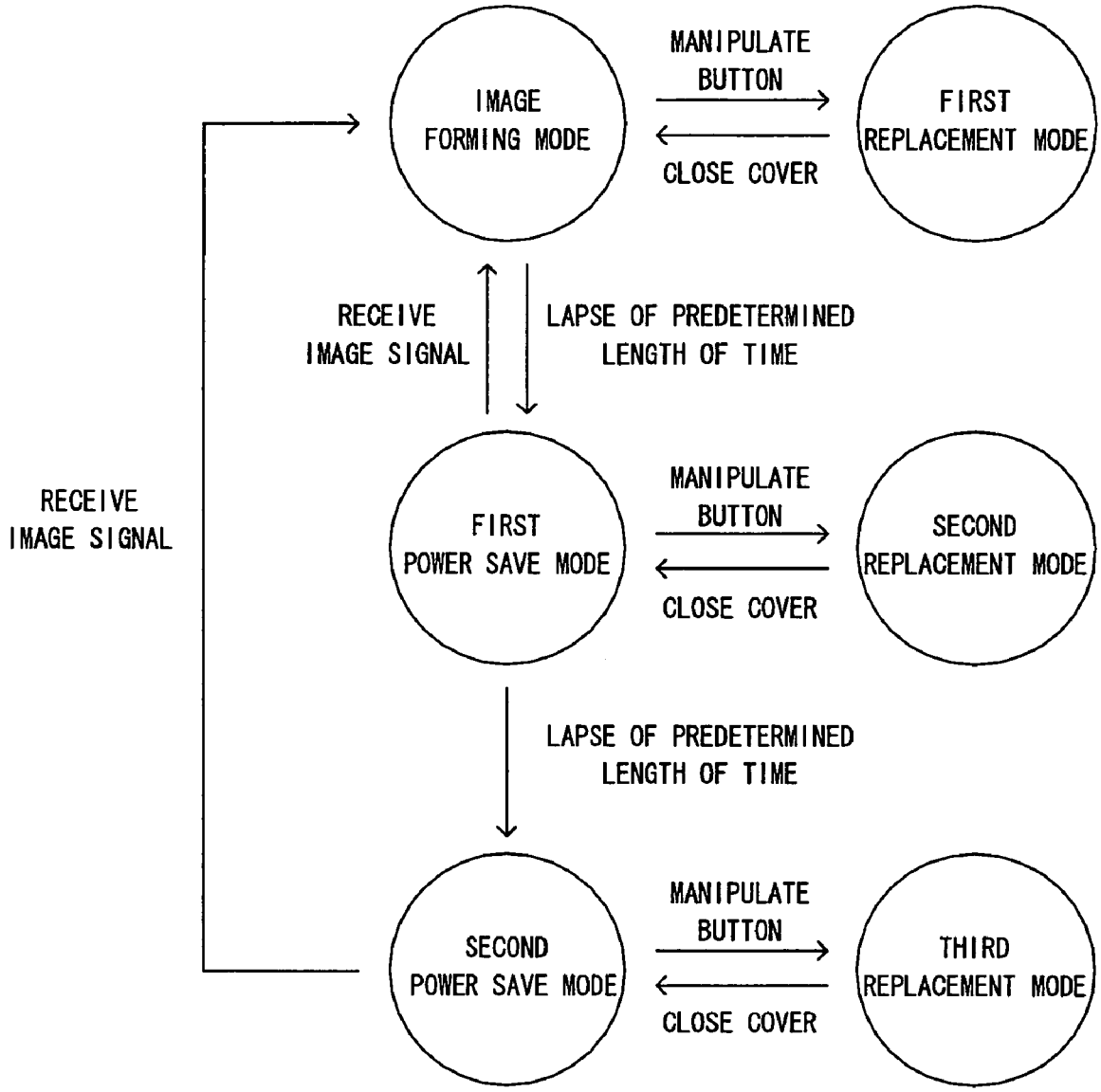
FIG. 18 is a drawing which shows how the apparatus is shifted between operation modes of the third embodiment of the invention.

FIG. 18 is a drawing which shows how the apparatus is shifted between operation modes. FIG. 19 is a table which shows operation statuses of the individual parts of the apparatus in each of the operation modes. As will be specifically described hereinlater, modes in parentheses shown in FIG. 19 do not represent the "operation mode" of the invention but simply indicates a certain operation status of the apparatus. The circles in FIG. 19 each indicate that the part of interest is in operation in each of the operation modes. The hyphens in the figure each indicate that the part of interest is deactivated.

When energized, the apparatus performs initialization before executing the image forming mode. In principle, the individual parts of the apparatus are operative in the image forming mode and hence, the apparatus is capable of immediately responding to an image signal from the external apparatus by forming, on a sheet S, an image corresponding to the image signal.

After the lapse of a predetermined length of time (say, five minutes) from the completion of the image formation, the apparatus is shifted to the first power save mode to reduce the power consumption in the standby state. As shown in FIG. 19, the first power save mode (abbreviated as "Power Save 1" in FIG. 19) deactivates some parts or limits the operations of some parts of the apparatus that consume relatively large amounts of power. Specifically, the high voltage sources (not shown) for applying bias voltages to the charger unit 3, the developers 4Y and such, and the exposure unit 6 are deactivated. Furthermore, the motors (not shown) for drivably rotating the rotary developing unit 4, the developing roller 44, the photosensitive member 22 and the intermediate transfer belt 71 are de-energized or the power source for these motors is deactivated. A heater of the fixing unit 9 is controllably set to a lower temperature than a normal fixing temperature, so as to reduce the power consumption. The heater is not completely turned off in order to permit the image forming operation to be started relatively quickly when the subsequent image signal is received. In addition, the heat generated in the apparatus is reduced by deactivating these parts in this manner, so that an unillustrated cooling fan may be reduced in rotational speed for further reducing the power consumption.

After the lapse of a predetermined length of time (say, 30 minutes) from the shift to the first power save mode, the apparatus is shifted to the second power save mode for the sake of further reducing the power consumption. As shown in FIG. 19, the second power save mode (abbreviated as "Power Save 2" in FIG. 19) deactivates more parts of the apparatus than the first power save mode. Specifically, the display unit 12 is turned off (specifically, a backlight of an LCD is turned off), while the heater of the fixing unit 9 and the cooling fan are also turned off. In this manner, all the parts of the apparatus except for the control circuits (the main controller 10 and engine controller 11) are deactivated, whereby the power consumption during standby is further reduced. Out of the control circuits, that for the display unit 12 may be deactivated as the backlight is turned off. However, the control circuit for the operation portion 13 need be always maintained in the operative state such as to respond to an operational input by the user on an as-needed basis.

When the apparatus in the first or second power save mode is applied with the image signal from the external apparatus such as a host computer, the CPU 111, receiving the image signal, re-starts the deactivated parts of the apparatus thereby shifting the apparatus to the image forming mode. After warm-up, the apparatus performs the image forming operation to form an image corresponding to the received image signal. It is noted here that the first power save mode controllably sets the heater temperature of the fixing unit 9 to a slightly lower level than the fixing temperature and hence, the warm-up operation takes a relatively short time. In the second power save mode, on the other hand, the heater temperature may sometimes be lowered nearly to the room temperature, so that the warm-up operation may take substantial time. The apparatus has not performed the image forming operation for a long period of time and hence, the ambient environmental conditions around the apparatus, such as room temperature and humidity, may possibly have been changed since the previous image formation. When the apparatus is shifted from the second power save mode to the image forming mode, therefore, it is desirable to re-adjust process conditions such as the level of bias potential and the intensity of exposure light beam, the bias potential and exposure light beam applied to the parts of the apparatus. The re-adjust process can be executed simultaneously with the warm-up operation of the heater.

In this apparatus, three replacement modes for mounting/dismounting the developer are provided in correspondence to the aforementioned three operation modes, respectively, which include the image forming mode, the first power save mode and the second power save mode. The "replacement mode" means herein a state where some parts of the apparatus are deactivated and where the rotary developing unit 4 is halted at the aforesaid mounting/dismounting position corresponding to any one of the developers so as to permit the mounting/dismounting of the developer of interest.

As described above, the image forming apparatus of this embodiment permits the mounting/dismounting of the developer only when the rotary developing unit 4 is positioned at the mounting/dismounting position under the control of the engine controller 10. Therefore, when the user performs the developer mounting/dismounting operation, the control circuits (the main controller 11 and the engine controller 10) and the driver of the rotary developing unit 4, out of the parts of the apparatus, must be in the operative state. Furthermore, the display unit 12 may preferably be in the operative state such as to display messages indicating the proceedings of the operation and the operation procedure to the user. The other parts of the apparatus that are not involved in the mounting/dismounting of the developer may optionally be in the operative state or in the inoperative state during the execution of the developer mounting/dismounting operation. However, the apparatus may encounter the following demands.

Firstly, in a case where the developer mounting/dismounting operation is performed during the execution of the image forming mode, the other parts of the apparatus that are not involved in the mounting/dismounting operation may preferably be placed in the operative state as far as possible. This is because there may be a case where the image forming apparatus is required to perform the image forming operation just after completion of the mounting/dismounting operation. This is exemplified by a case where any one of the developers runs out of toner in the course of successively forming a large number of images. What is demanded in such a case is to start forming the succeeding images without delay after the developer is replaced during the suspension of the image forming operation. In this case, if the laser oscillation of the exposure unit 6 is stopped or the temperature of the fixing unit 9 is lowered, for example, the wait time between the end of the replacement operation and the formation of the succeeding image becomes too long to meet the user demand. It is therefore desirable in this case that the individual parts of the apparatus are maintained in the operative state as far as possible.

On the other hand, let us consider a case where the developer mounting/dismounting operation is performed during the execution of the first or second power save mode. What is demanded in this case is to consume as little power as possible during the mounting/dismounting operation rather than to start the image forming operation immediately after completion of the mounting/dismounting operation. It is therefore desirable that those parts of the apparatus which are not involved in the mounting/dismounting operation are deactivated during the mounting/dismounting operation which is performed with the first or second power save mode in execution. In this case, if the power save mode is cancelled to return the apparatus as a whole to the operative state, a drawback of wasteful power consumption results.

Thus, the operation status which the apparatus is required to assume during the developer mounting/dismounting operation varies depending upon whether the apparatus is executing the image forming mode or the first or second power save mode. Hence, the embodiment provides the three different replacement modes corresponding to the three operation modes, respectively. When the user manipulates the apparatus to request the mounting/dismounting of a developer during the execution of any one of the operation modes, the apparatus is shifted to the replacement mode corresponding to the current operation mode. When the mounting/dismounting operation is completed, the apparatus is returned to the previous operation mode. This obviates the aforementioned drawbacks, so that the apparatus may reduce the wasteful power consumption without impairing the user convenience.

Specifically, the individual replacement modes may be defined as follows. In a first replacement mode (abbreviated as "Replacement 1" in FIG. 19) corresponding to the image forming mode, the control circuits, the display 12 and the driver of the rotary developing unit 4, out of the parts of the apparatus, need be maintained in the operative state such as to support the mounting/dismounting operation. For the sake of quickly returning the apparatus to the previous state after completion of the operation, the exposure unit 6 and the fixing unit 9 may preferably be maintained in the operative state. However, it is unnecessary to maintain the other parts of the apparatus in the operative state. It is rather preferred to deactivate the parts applied with high voltages and the movable parts. Incidentally, the rotational speed of the cooling fan may be lowered because the heat generated in the apparatus becomes less than the heat generated during the image forming operation.

In a second replacement mode (abbreviated as "Replacement 2" in FIG. 19) corresponding to the first power save mode, the driver of the rotary developing unit 4 is activated in addition to those parts operative in the first power save mode. In a third replacement mode (abbreviated as "Replacement 3" in FIG. 19) corresponding to the second power save mode where only the control circuits are operative, the display 12 and the driver of the rotary developing unit 4 are activated additionally. By doing so, the increase of the power consumption may be minimized.

When the mounting/dismounting operation is completed, the apparatus is returned from the replacement mode to the previous operation mode. Thus, the increase of the power consumption associated with the mounting/dismounting operation may be minimized. What is more, the efficiency of the mounting/dismounting operation is not decreased. The completion of the mounting/dismounting operation may be determined as follows, for example. In a case where the user manipulates the operation portion 13 to input a command corresponding to the mounting/dismounting of a developer, the user is expected to perform subsequently a series of operations to open the outside cover 320, to perform the mounting/dismounting of the developer, and to close the outside cover 320 again. Therefore, if the aforesaid operational input is followed by opening the outside cover 320 and closing the outside cover 320 again, it may be assumed that the mounting/dismounting operation is completed. The opening/closure of the outside cover 320 may be detected by means of a limit switch, for example, which is disposed at the apparatus body and is adapted to close contacts as pressed by a projection formed at the outside cover 320.

In a case where the user manipulates the operation portion to input command to perform the mounting/dismounting of plural developers, the developing unit 4 is rotated at each closure of the cover, so as to shift the developer exposed through the developer opening 335. The completion of the mounting/dismounting operation may be determined by confirming that the opening/closure of the cover is repeated the number of times equal to the number of developers to be mounted/dismounted. An alternative arrangement may be made such as to require the user to apply an operational input indicative of the completion of the mounting/dismounting operation, for example. Otherwise, whether the replacement of the developer is done or not may be determined by checking the contents of the memory disposed in the developer.

Figure 20:
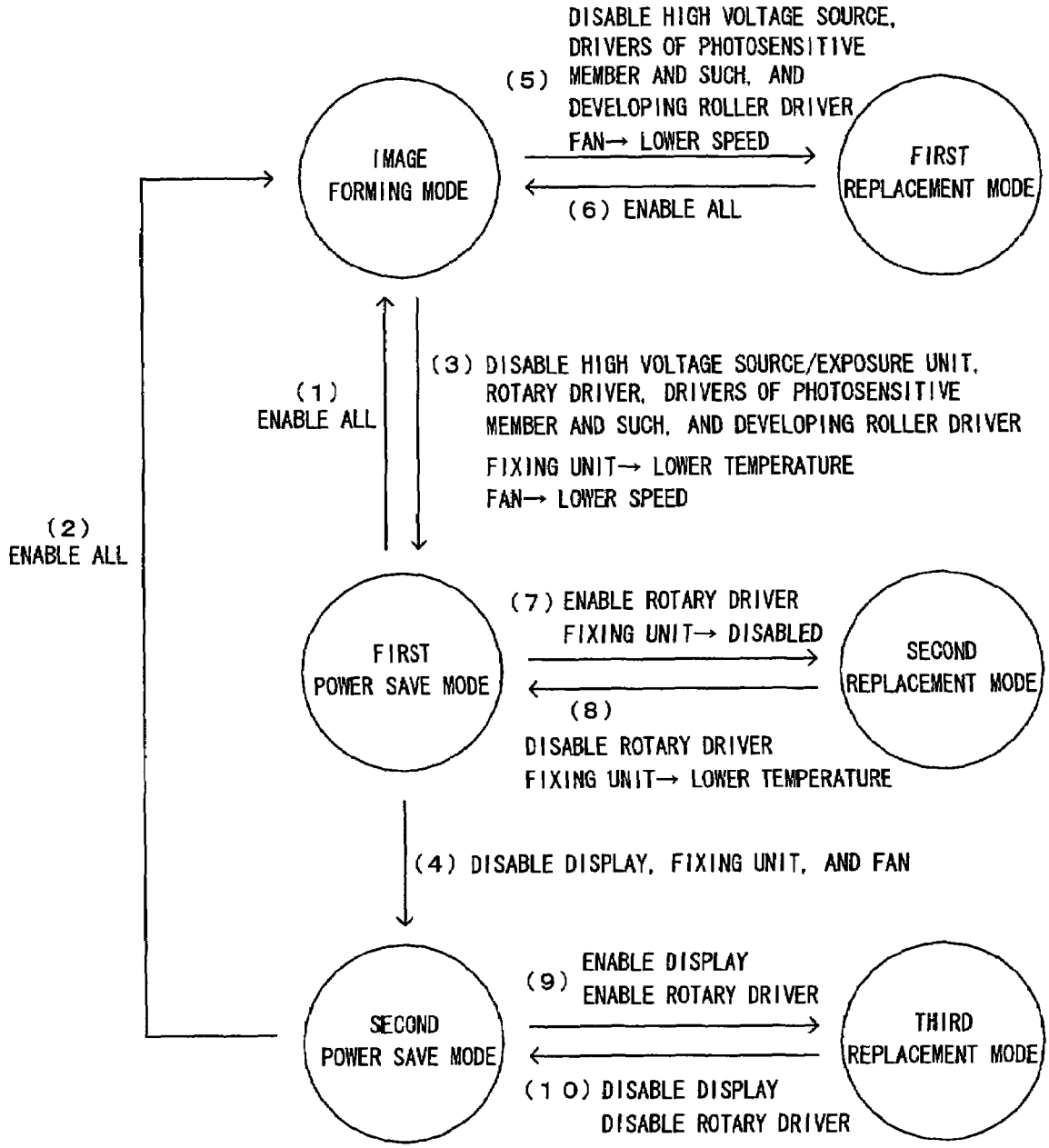
FIG. 20 is a drawing which outlines the changes of operation status of the apparatus in conjunction with the operation mode shift.

FIG. 20 is a drawing which outlines the changes of operation status of the apparatus in conjunction with the operation mode shift. When the apparatus is shifted from the first or second power save mode to the image forming mode (FIG. 20(1) and FIG. 20(2)), the operations of the all parts of the apparatus inclusive of those deactivated are enabled. When the apparatus is shifted from the image forming mode to the first power save mode (FIG. 20(3)), the operations of the high voltage source and exposure unit 6 as well as the drivable rotation of the rotary developing unit 4, the photosensitive member 22, the intermediate transfer belt 71 and the developing roller 44 are disabled. The term "photosensitive member and such" in FIG. 7 means the photosensitive member and the intermediate transfer belt. Furthermore, the heater at the fixing unit 9 is so controlled as to set the temperature thereof to a lower level, whereas the rotational speed of the cooling fan is lowered. When the apparatus is shifted from the first power save mode to the second power save mode (FIG. 20(4)), the operations of the display unit 12 and the cooling fan are disabled.

When the apparatus is shifted from the image forming mode to the first replacement mode (FIG. 20(5)), the high voltage source and the drivers of the photosensitive member 22, the intermediate transfer belt 71 and the developing roller 44 are disabled, whereas the cooling fan is decreased in speed. At this time, the rotary developing unit 4 is positioned at the mounting/dismounting position so as to permit the mounting/dismounting of the developer. Conversely, when the apparatus is shifted from the first replacement mode to the image forming mode (FIG. 20(6)), the operations of the all parts of the apparatus are enabled.

When the apparatus is shifted from the first power save mode to the second replacement mode (FIG. 20(7)), the deactivated driver of the rotary developing unit 4 is re-activated so as to position the rotary developing unit 4 at the mounting/dismounting position, whereas the fixing unit 9 is turned off. Conversely, when the apparatus is shifted from the second replacement mode to the image forming mode (FIG. 20(8)), the rotary developing unit 4 is returned to the home position before the driver thereof is deactivated, whereas the fixing unit 9 is controllably placed in the low-temperature state again. Thus, the apparatus is returned to the first power save mode.

The apparatus of this embodiment is designed to be shifted to the second power save mode after the lapse of the predetermined length of time from the shift to the first power save mode. Hence, the first power save mode does not last for a long period of time. Accordingly, when the apparatus is shifted from the first power save mode to the image forming mode, so much time has not passed from the end of the previous image forming operation. Therefore, the re-adjustment of the process conditions is not necessary. In a case where the replacement of the developer is performed, however, the re-adjustment is necessary regardless of the length of elapsed time. That is, the process conditions must be re-adjusted. In this connection, the following procedures are taken when the apparatus is shifted from the first power save mode to the image forming mode. The process conditions are re-adjusted if the developer is mounted prior to the shift to the image forming mode. On the other hand, the re-adjustment of the process conditions is omitted if the developer is not mounted prior to the shift to the image forming mode.

When the apparatus is shifted from the second power save mode to the third replacement mode (FIG. 20(9)), the deactivated driver of the rotary developing unit 4 is re-activated so as to position the rotary developing unit 4 at the mounting/dismounting position. Furthermore, the deactivated backlight of the display unit 12 is re-activated in order to support the mounting/dismounting operation by displaying various kinds of messages. Conversely, when the apparatus is shifted from the third replacement mode to the image forming mode (FIG. 20(10)), the rotary developing unit 4 is returned to the home position before the driver thereof is deactivated. In the meantime, the backlight of the display unit 12 is turned off again, so that the apparatus is returned to the second power save mode.

As described above, the embodiment is adapted to effect the three replacement modes in correspondence to the three operation modes of the image forming mode, the first power save mode and the second power save mode, respectively. In each of the replacement modes, the rotary developing unit 4 is positioned at the mounting/dismounting position thereby to establish the state to permit the mounting/dismounting of the developer. The difference among the individual replacement modes consists in whether the other parts than the developing unit are activated or deactivated. Specifically, in the first replacement mode corresponding to the image forming mode, out of the individual operative parts of the apparatus in the image forming mode, those which do not affect the subsequent image forming operation and developer mounting/dismounting operation are deactivated. Thus, the convenience in performing the mounting/dismounting operation may be offered and besides, the wait time between the end of the operation and the output of the image may be shortened.

In the second replacement mode corresponding to the first power save mode, out of the deactivated parts in the first power save mode, only those which are involved in the mounting/dismounting operation are activated. At completion of the operation, the apparatus is returned to the first power save mode again. In this manner, the power consumption may be reduced but the user convenience in performing the mounting/dismounting operation is not impaired. In the third replacement mode corresponding to the second power save mode further reducing the power consumption, as well, out of the deactivated parts in the second power save mode, only those which are involved in the mounting/dismounting operation are activated, whereby the same working effects are obtained.

As described above, the embodiment provides the replacement modes for the respective operation modes. Hence, the operation statuses of the individual parts of the apparatus which are not involved in the mounting/dismounting operation may be discretely set in each replacement mode. In the replacement mode corresponding to the image forming mode, the exposure unit 6 and the fixing unit 9 slow to be re-activated stay in the operative state, so that the image forming operation may be started without delay after completion of the operation. In the replacement modes corresponding to the first and second power save modes, on the other hand, only those parts required for the mounting/dismounting operation are activated, so that the wasteful power consumption may be reduced. Furthermore, some of the parts required for the mounting/dismounting operation are deactivated while the mounting/dismounting operation is not carried out. The deactivated portions are activated when the user applies the operational input indicating the execution of the mounting/dismounting operation. Hence, the power consumption in the power save mode may be further reduced.

According to this embodiment, the apparatus is shifted to any one of the replacement modes when the user applies to the operation portion 13 the operational input indicating the execution of the mounting/dismounting of the developer, whereas the apparatus is returned to the previous operation mode when the outside cover 320 is closed. Such an arrangement permits the time of start or the time of end of the mounting/dismounting operation to be determined based on the operation by the user.

On the assumption that the mounting/dismounting operation is performed during a period between the operational input applied by the user indicating the execution of the mounting/dismounting operation and the closure of the outside cover 320, the embodiment holds the rotary developing unit 4 halted at the mounting/dismounting position during this time period, the mounting/dismounting position at which the developer may be mounted/dismounted. However, the embodiment inhibits the mounting/dismounting of the developer in any other period than the above. Such an arrangement prevents the apparatus from being damaged by the operation error committed by the user and also permits the service life of the apparatus to be managed properly.

According to the embodiment as described above, each of the developers 4Y, 4M, 4C, 4K is equivalent to the "process unit" of the invention. The developing unit 4 is mounted with these developers and is positioned at the mounting/dismounting position or any other position, thereby switching the apparatus between the state to permit the mounting/dismounting of the developer and the state to inhibit the mounting/dismounting of the developer. This developing unit 4 functions as the "development rotary" and the "switching unit" of the invention. In this embodiment, the main controller 11 and the engine controller 10 cooperate with each other to function as the "controller" of the invention. In this embodiment, the outside cover 320 covering the engine EG is equivalent to the "cover member" of the invention. The operation portion 13 including a group of buttons disposed at the upper panel of the apparatus is equivalent to the "command input unit" of the invention.

The first through third replacement modes of the embodiment are equivalent to "first through third mounting/dismounting permission states" of the invention, in which the rotary developing unit 4 is positioned at the mounting/dismounting position to permit the mounting/dismounting of the developer. On the other hand, a state where the rotary developing unit 4 is positioned at place other than the mounting/dismounting position is equivalent to a "mounting/dismounting inhibition state" of the invention.

(Modifications)

It is noted that the invention is not limited to the foregoing embodiments and various changes and modifications other than the above may be made thereto so long as such changes and modifications do not deviate from the scope of the invention. For instance, the foregoing embodiments pertain to the apparatus which permits the mounting/dismounting of the developers 4Y and such as the "process unit" of the invention by way of the operation of rotatably positioning the developing unit 4 as the "switching unit" hereof. However, the invention is not limited to this. The invention is applicable to, for example, an apparatus wherein an electromagnetic locking mechanism is provided for locking the photosensitive member 2 or another unit and is operated to unlock the photosensitive member or the like thereby permitting the dismounting of the unit of interest. In this case, the unit of interest is the "process unit" of the invention, whereas the locking mechanism functions as the "switching unit" hereof.

While the embodiment is arranged to enable/disable the operations of the individual parts of the apparatus by way of the enable control signals applied from the CPU 101 to the individual parts, the invention is not limited to this. For instance, an interlock switch such as used in the prior art may be employed for shutting down the power supply such that some parts of the apparatus except for the developing unit 4 are deactivated when the outside cover is opened.

According to the first embodiment, whether the mounting/dismounting of the developer 4Y or such is done or not is determined by means of the limit switch 132 detecting the opening/closing of the inside cover 130 covering the developer opening 135. Alternatively, the mounting/dismounting of the developer may be detected by means of a sensor based on the optical or electromagnetic principles, the sensor including, for example, photointerrupters, reed switches and the like. Furthermore, such a sensor may also be mounted to the support frame 40 of the developing unit 4 such as to determine whether the developer is mounted to the frame 40 or not.

In addition, the method of the second embodiment for determining whether the replacement operation is done or not is also applicable to the apparatus of the first embodiment. The apparatus of the first embodiment determines the mounting/dismounting of the developer to be done when the inside cover 130 once opened is closed again. The apparatus may be modified as follows. In spite of the detection of the opening/closing of the inside cover 130, the apparatus may determine the mounting/dismounting of the developer to be undone if the inside cover is opened for a short time.

While the first embodiment includes: the inside cover 130 manipulated when the mounting/dismounting of the developer is performed; and the replacement command buttons 151Y and such for causing the developing unit 4 to be moved to the mounting/dismounting position, the invention is also applicable to an apparatus which includes either one of these members or which includes none of these members. The invention is particularly effective in apparatuses which are at least designed to be shifted to the state to permit the mounting/dismounting of the process unit in response to a request from the user or the external apparatus.

While the outside cover 320 of the second and third embodiments is so constructed as to cover a photosensitive member opening 325 and the developer opening 335 which are formed in the apparatus body, the invention is not limited to this. For instance, there may be provided covers discretely covering the individual openings. Likewise to the apparatus of the first embodiment, the cover may have a double structure including the inside cover and the outside cover.

While the aforementioned third embodiment provides the two types of power save modes in addition to the image forming mode, the invention is not limited to this. The invention is also applicable to an apparatus which provides only one type of power save mode, for example.

Furthermore, the invention is not limited to the constitutions of the foregoing embodiments and may also be applied to, for example, an apparatus including a developer for a black toner and operative to form a monochromatic image, apparatuses including transfer media (transfer drum, transfer sheet and the like) other than the intermediate transfer belt; and other image forming apparatuses such as copiers and facsimile machines.

INDUSTRIAL APPLICABILITY

The invention may preferably be applied to the image forming apparatus including the process unit mountable in the apparatus body, and the control method thereof. The application of the invention enables the reduction of the wasteful power consumption without impairing the user convenience in performing the operation of mounting/dismounting the process unit.

The invention claimed is:

1. An image forming apparatus comprising:

a process unit capable of being removably mounted in an apparatus body;

a switching unit for switching the apparatus between a state to permit the mounting/dismounting of the process unit and a state to inhibit the mounting/dismounting of the process unit;

a cover member which is free to be shifted between an open position and a close position with respect to the apparatus body and which, in the close position, serves to restrict an operation of mounting/dismounting the process unit by a user; and a controller capable of executing a power save mode by deactivating some parts, inclusive of the switching unit, of the apparatus, the power save mode in which the apparatus consumes less power than that consumed during an image forming operation, wherein when the cover member is opened during the execution of the power save mode, the controller cancels the power save mode to shift the apparatus to a state to permit an operation of the switching unit, and when the cover member is closed during the execution of the power save mode, the controller maintains the power save mode.

2. An image forming apparatus according to claim 1, further comprising a command input unit for accepting a process-unit mounting/dismounting command from the user, wherein when the command input unit accepts the mounting/dismounting command input, the controller operates the switching unit to shift the apparatus to the state to permit the mounting/dismounting of the process unit.

3. An image forming apparatus according to claim 2, wherein the command input unit is designed not to accept the command inputted by the user while the cover member is in the close position.

4. An image forming apparatus according to claim 1, further comprising a power source for supplying power to the switching unit, wherein the controller deactivates the power source in the power save mode.

5. An image forming apparatus according to claim 1, further comprising a development rotary capable of being mounted with a developer as the process unit and driven into rotation by a driver, wherein the driver functions as the switching unit by selectively positioning the development rotary at a predetermined mounting/dismounting position defined in correspondence to the developer for permitting the mounting/dismounting of the developer, or at any other position.

6. An image forming apparatus according to claim 1, wherein the controller starts the power save mode when a predetermined length of time has passed in a state where the apparatus is applied with no operation request from an external apparatus connected with the apparatus or from the user.

7. A control method of an image forming apparatus including: a process unit capable of being removably mounted in an apparatus body; a switching unit for switching the apparatus between a state to permit the mounting/dismounting of the process unit and a state to inhibit the mounting/dismounting of the process unit; and a cover member which is free to be shifted between an open position and a close position with respect to the apparatus body and which, in the close position, serves to restrict an operation of mounting/dismounting the process unit by a user, wherein a power save mode in which the apparatus consumes less power than that consumed in an image forming operation is executed as required by deactivating some parts, inclusive of the switching unit, of the apparatus, and wherein when the cover member is opened during the execution of the power save mode, the power save mode is cancelled to shift the apparatus to a state to permit an operation of the switching unit, and when the cover member is closed during the execution of the power save mode, the controller maintains the power save mode.

* * * * *